US011158293B1

(12) United States Patent
Milligan

(10) Patent No.: US 11,158,293 B1
(45) Date of Patent: Oct. 26, 2021

(54) MUSICAL INSTRUMENT WITH INTERCHANGEABLE PARTS

(71) Applicant: Paul Milligan, Lexington, IN (US)

(72) Inventor: Paul Milligan, Lexington, IN (US)

( * ) Notice: Subject to any disclaimer, the term of this patent is extended or adjusted under 35 U.S.C. 154(b) by 0 days.

(21) Appl. No.: 17/132,413

(22) Filed: Dec. 23, 2020

(51) Int. Cl.
*G10D 3/095* (2020.01)
*G10D 1/08* (2006.01)
*G10D 3/04* (2020.01)

(52) U.S. Cl.
CPC ..... *G10D 3/095* (2020.02); *G10D 1/085* (2013.01); *G10D 3/04* (2013.01)

(58) Field of Classification Search
CPC ..... G10D 3/095; G10D 1/085; G10D 3/04
See application file for complete search history.

(56) References Cited

U.S. PATENT DOCUMENTS

2003/0164080 A1* 9/2003 Childress ..... G10D 3/06 84/291
2016/0019870 A1* 1/2016 Park ..... G10D 1/085 84/292

* cited by examiner

*Primary Examiner* — Kimberly R Lockett
(74) *Attorney, Agent, or Firm* — Myers Andras LLP; Joseph C. Andras

(57) ABSTRACT

A modular stringed instrument comprising a precision-machined components which are assembled "out of the box" to build an instrument having a desired, reproducible sound is disclosed. The modular design of the stringed instrument allows for complete customization to a player's tastes such as allowing the player to select head stock styles, handedness, neck thicknesses, scale length, body style, and electronics. A custom designed bridge and mounting system allow for analog bridge placement along the mounting plate which can be custom machined to accommodate a players wishes. The placement of the bridge is precision both in forward/back position but also in height and, if desired, in up to six degrees of freedom. Each string height is adjustable as well as integral to the bridge.

30 Claims, 30 Drawing Sheets

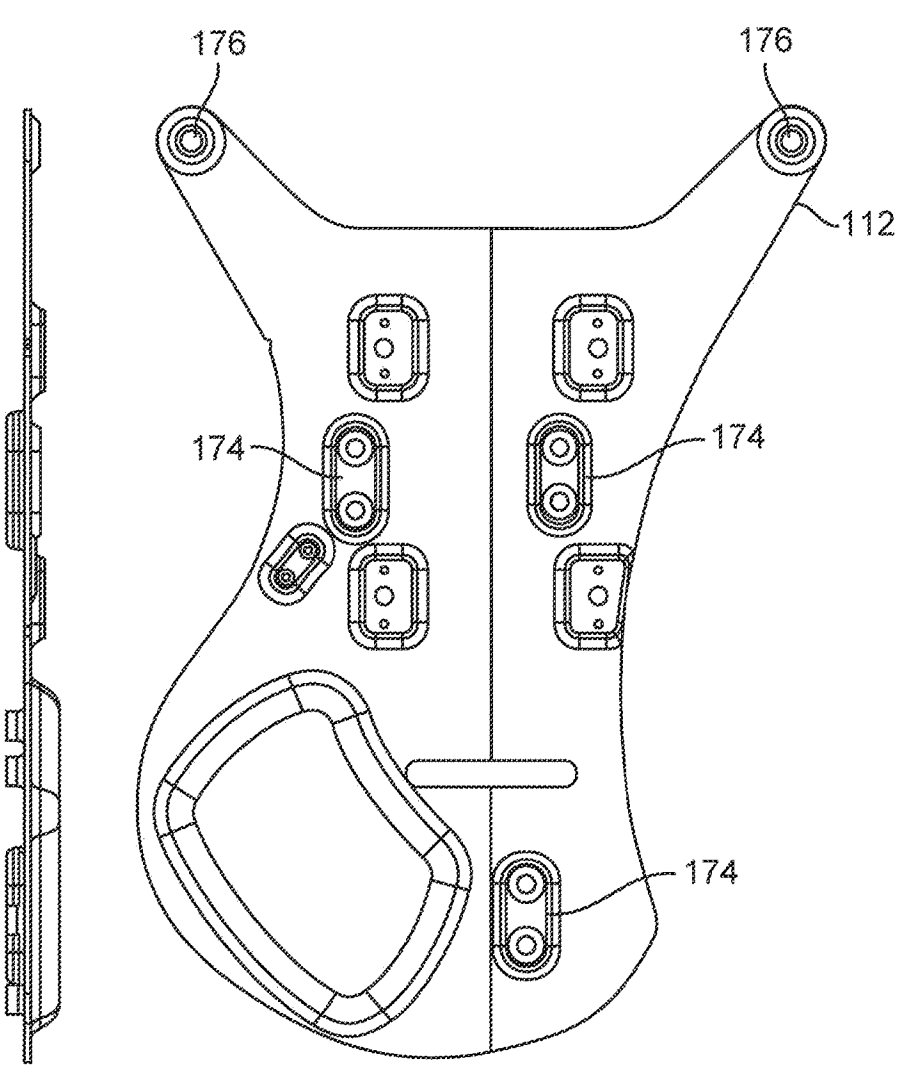
FIG. 10C
FIG. 10B
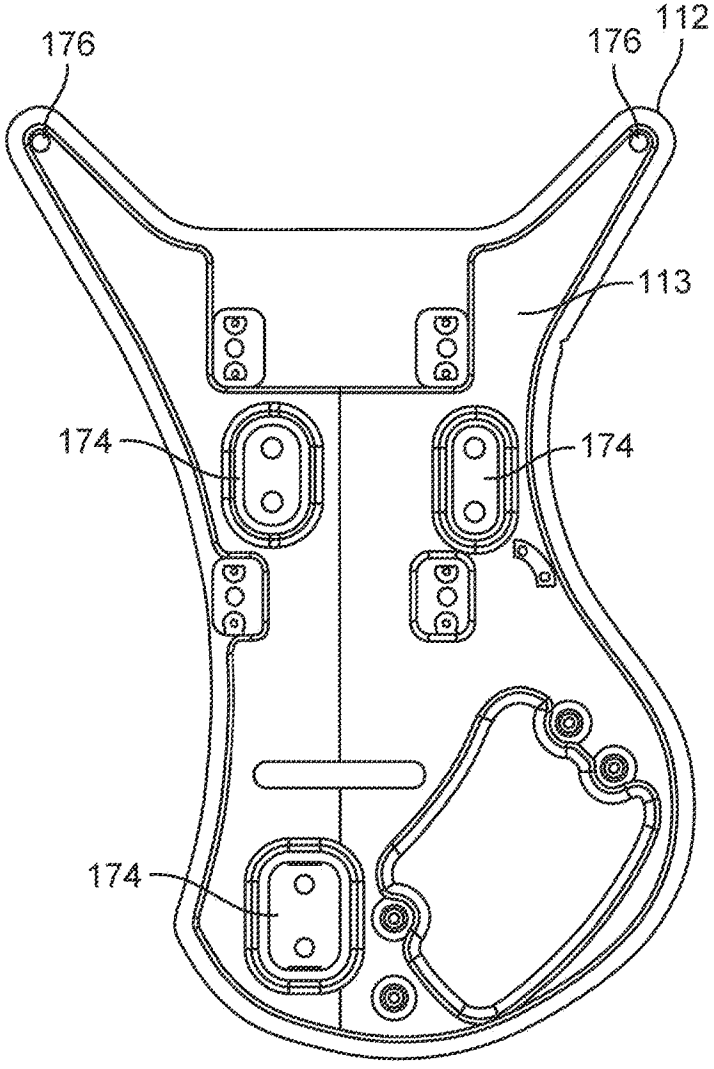
FIG. 10A

MUSICAL INSTRUMENT WITH INTERCHANGEABLE PARTS

BACKGROUND OF THE INVENTION

1. Field of the Invention

Embodiments relate generally to stringed musical instruments, and more particularly, to modular stringed instruments with interchangeable parts.

2. Description of the Related Art

Traditionally, commercially-available guitars and other stringed instruments are often sold as fully-assembled instruments. More recently, modular stringed instruments are available in which components can be assembled and swapped out to form instruments with differing musical properties. However, minor differences in guitars may require a luthier to modify the guitar to achieve a desired sound.

Hence, a need exists to provide modular stringed instruments that create a desired sound without having the need of a luthier to assemble or modify the instruments.

SUMMARY OF THE INVENTION

In the first aspect, a modular stringed instrument is disclosed. The modular stringed instrument comprises a body comprising a top portion and a bottom portion. The bottom portion having a generally flat rear surface and a bottom portion perimeter, the bottom portion having an inner surface opposite the generally flat rear surface. The top portion having a face and vertical walls extending downward forming an outermost perimeter of the body. The top portion is configured to receive and detachably couple with the bottom portion, the vertical walls of the top portion engaging with the bottom portion perimeter. The top portion and the bottom portion forming an inner cavity, the top portion having a neck receiving portion and a bridge assembly receiving portion, the bridge assembly receiving portion comprising one or more nonplanar features.

The modular stringed instrument further comprises a bridge assembly comprising a bridge and a bridge plate, the bridge plate detachably coupled to the bridge. The bridge plate is detachably coupled to the bridge assembly receiving portion of the top portion of the body. The bridge plate inversely contoured to the nonplanar features of the bridge assembly portion to receive and interlock with the bridge assembly receiving portion, wherein the bridge plate assembly portion is shaped to precisely position and secure the bridge plate on the top portion of the body. The modular stringed instrument further comprises a neck detachably coupled to the top portion of the body, and a neck head detachably coupled to the neck.

In a first preferred embodiment, the bridge plate comprises a first surface having a first thickness $t_1$ and a raised step having a second thickness $t_2$, where $t_2$ is greater than $t_1$, wherein the bridge may be coupled to the bridge plate on the first surface or coupled to the raised step. The one or more nonplanar features of the bridge assembly receiving portion preferably comprises a flat surface and a raised surface, and the bridge plate is contoured to have an inner aperture to receive the raised surface of the bridge receiving portion. The bridge plate preferably accommodates a variable scale length that preferably can be set to anywhere between 24" and 26" so that, for example, it can accommodate a scale length of 24" or 25" or, more commonly for most, a scale length of 24.75 inches or a scale length of 25.5 inches. It may be variably set in an "analog" or non-discrete manner within a single desired range in some embodiments, or discretely set in a coarse/fine manner to the vicinity of two or more specific predefined scale lengths in other embodiments. The bridge preferably further comprises adjustable claw pads for each string to allow for micro-adjustments of each string forward and backward in a direction parallel with the strings and raised and lowered in a vertical direction perpendicular to the strings.

The modular string instrument is preferably assembled using mechanical fasteners without the use of adhesives. The bridge assembly is preferably custom machined for a user. One or more of the following are preferably be customized to a user's preference: head stock style, the left-right handedness, the neck thickness, the scale length, the body style, and/or electronics. The neck preferably comprises a channel formed in the inner surface of the neck, the channel providing rigidity and stiffness for the neck.

The modular stringed instrument preferably further comprises a fretboard detachably coupled to the neck, wherein the neck and the fretboard each having three holes that allow the neck and the fretboard to be secured together via mechanical fasteners, wherein the placement of the holes denotes the octave points on a 25.5 inch fretboard.

In a second aspect, a modular stringed instrument is disclosed. The modular stringed instrument comprises a body comprising a top portion and a bottom portion, the bottom portion having a generally flat rear surface and a bottom portion perimeter. The bottom portion has and an inner surface opposite the generally flat rear surface. The inner surface supporting instrument electronics extending upward away from the inner surface. The top portion has a face and vertical walls extending downward forming an outermost perimeter of the body, the top portion configured to receive and detachably couple with the bottom portion. The vertical walls of the top portion engaging with the bottom portion perimeter, the top portion and the bottom portion forming an inner cavity, the top portion having a neck receiving portion and a bridge assembly receiving portion, the bridge assembly receiving portion comprising one or more nonplanar features, the top portion having apertures for receiving the instrument electronics of the bottom portion.

The modular stringed instrument further comprises a bridge assembly comprising a bridge and a bridge plate. The bridge plate is detachably coupled to the bridge, the bridge plate detachably coupled to the bridge assembly receiving portion of the top portion of the body. The bridge plate is inversely contoured to the nonplanar features of the bridge assembly portion to receive and interlock with the bridge assembly receiving portion, wherein the bridge plate assembly portion is shaped to precisely position and secure the bridge plate on the top portion of the body. The modular stringed instrument further comprises a neck having a neck base portion at one end of the neck and a neck top portion on the end of the neck opposite the neck base portion, the neck base portion detachably coupled to the neck receiving portion of the top portion of the body, and a neck head detachably coupled to the neck.

In a second preferred embodiment, the bridge plate comprises a first surface having a first thickness $t_1$ and a raised step having a second thickness $t_2$, where $t_2$ is greater than $t_1$, wherein the bridge may be coupled to the bridge plate on the first surface or coupled to the raised step. The one or more nonplanar features of the bridge assembly receiving portion preferably comprises a flat surface and a raised surface, and the bridge plate is contoured to have an inner aperture to receive the raised surface of the bridge receiving portion. The bridge preferably further comprises adjustable claw pads for each string to allow for micro-adjustments of each string forward and backward in a direction parallel with the strings and raised and lowered in a vertical direction perpendicular to the strings. The bridge preferably further comprises adjustable claw pads for each string to allow for micro-adjustments of each string forward and backward in a direction parallel with the strings and raised and lowered in a vertical direction perpendicular to the strings. The neck preferably comprises a channel formed in the inner surface of the neck, the channel including a desired geometry for creating a rib that provides rigidity and stiffness for the neck. In addition, the channel related rib controls may be varied by the designer to provide acoustic benefits, i.e. go create the desired bow-back. The modular stringed instrument preferably further comprises a fretboard detachably coupled to the neck, wherein the neck and the fretboard each having three holes that allow the neck and the fretboard to be secured together via mechanical fasteners, wherein the placement of the holes denotes the octave points on a 25.5 inch fretboard.

In a third aspect, a modular stringed instrument is disclosed. The modular stringed instrument comprises a body comprising a top portion and a bottom portion. The bottom portion has a generally flat rear surface and a bottom portion perimeter, the bottom portion having and an inner surface opposite the generally flat rear surface. The inner surface supporting instrument electronics extending upward away from the generally flat rear surface. The top portion has a face and vertical walls extending downward from an outermost perimeter of the face, the top portion configured to receive and detachably couple with the bottom portion, the vertical walls of the top portion engaging with the bottom portion perimeter. The top portion and the bottom portion forming an inner cavity. The top portion has apertures for receiving the instrument electronics of the bottom portion. The top portion has a neck receiving portion and a bridge assembly receiving portion, the bridge assembly receiving portion comprising a flat surface and a raised surface forming a rectangle.

The modular stringed instrument further comprises a bridge assembly comprising a bridge and a bridge plate. The bridge plate is detachably coupled to the bridge and to the bridge receiving portion of the top portion of the body. The bridge plate has an inner rectangle aperture to receive the raised surface of the bridge receiving portion, wherein the inner aperture forms a rectangle surrounding the raised surface of the neck receiving portion of the top portion precisely positions and secures the bridge plate.

The modular stringed instrument further comprises a neck having a neck base portion at one end of the neck and a neck top portion on the end of the neck opposite the neck base portion, the neck base portion detachably coupled to the neck receiving portion of the top portion of the body, and a neck head detachably coupled to the neck.

In a third preferred embodiment, the bridge plate comprises a first surface having a first thickness $t_1$ and a raised step having a second thickness $t_2$, where $t_2$ is greater than $t_1$, wherein the bridge may be coupled to the bridge plate on the first surface or coupled to the raised step. The neck preferably comprises a channel formed in the inner surface of the neck, the channel providing rigidity and stiffness for the neck. The modular stringed instrument further preferably comprises a fretboard detachably coupled to the neck, wherein the neck and the fretboard each having three holes that allow the neck and the fretboard to be secured together via mechanical fasteners, wherein the placement of the holes denotes the octave points on a 25.5 inch fretboard.

These and other features and advantages of the invention will become more apparent with a description of preferred embodiments in reference to the associated drawings.

DESCRIPTION OF THE DRAWINGS

FIG. 10A is a top view of the bottom portion of the stringed musical instrument.

FIG. 10B is an elevation view of the bottom portion of the stringed musical instrument.

FIG. 10C is a bottom view of the bottom portion of the stringed musical instrument.

DETAILED DESCRIPTION OF THE PREFERRED EMBODIMENTS

Figure 1:
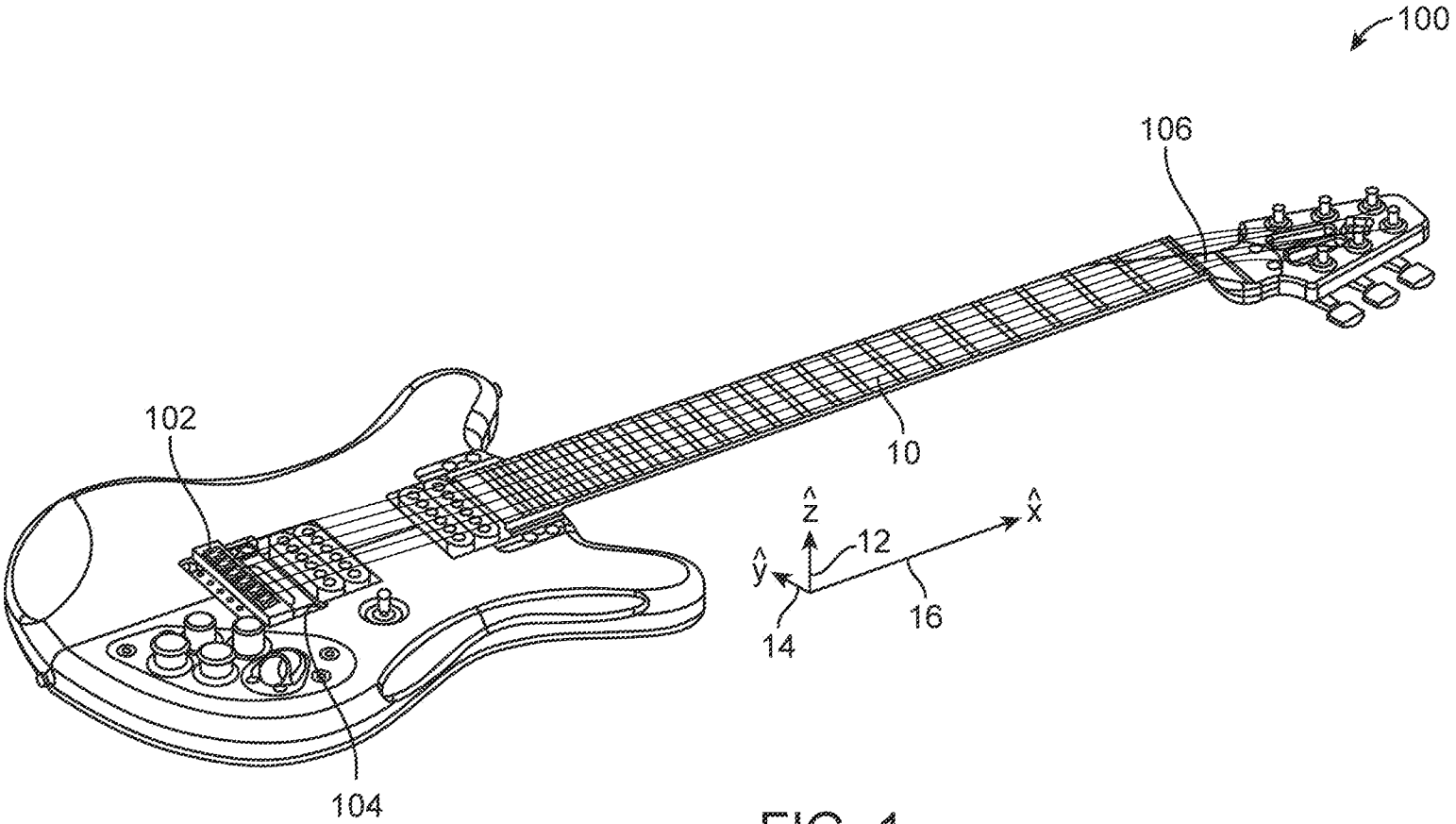
FIG. 1 is a perspective view of a stringed musical instrument with interchangeable parts in one or more embodiments.

In an embodiment, a modular stringed instrument comprises precision-machined components which are assembled "out of the box" to build an instrument having a desired and reproducible sound. The components of the musical instrument may be machined or precisely formed in metal such as aluminum with tight dimensional tolerances. The components are designed to detachably couple with other components to form the stringed musical instrument assembled with mechanical fasteners so that sections of the instrument may be replaced with other components. The components are designed to be reproducibly connected and interlocked with other components, so the components are precisely and securely positioned. The various components may be customized and may be substituted in the modular stringed instrument to accommodate a player's individual taste. For example, in one or more embodiments, the modular design of the guitar allows for complete customization to a player's tastes such as allowing the player to select head stock styles, handedness, neck thicknesses, scale length, body style, and electronics.

In an embodiment, a custom designed bridge and mounting system allow for analog bridge placement along the bridge plate which can be custom machined to accommodate a players wishes. The placement of the bridge is precise both in the forward/back position but also in the height. Each string height is adjustable as well integral to the bridge. The bridge and the mounting plate are designed to be sold as an assembly and not independently to be used only with the specialty electric guitar. Each pad that the strings go over is customization as well.

In an embodiment, the modularity of the fret board allows for infinite scale lengths (within the capacity of the guitar), fret heights, and styles. It is noted that scalloped, fretless and unique innovations currently in the marketplace that are underutilized due to a lack of this platform. The neck designed for the modular fret board (having unique bolts on back to denote the octave points on a 25.5 fret board) has bolts that are positioned on back to alert player by feel. In one or more embodiments, drop out electric components allow the electronics to be installed without leaving the entire guitar with technician and the electronics are modular such that the strings are changed to change out the pickups for a different tone. The guitar assembles correctly out of the box with no need to have a Luthier go over it subsequent to purchase. Moreover, the guitar contains absolutely no glue only changeable mechanical fasteners In one or more embodiments, the fret board is fully machined from one piece of aluminum that is then coated with type 2 anodizing. This provides superior life in comparison to rose wood and glued in stainless steel frets. This is a significant step forward in technology and allows a new fret board to be purchased then replaced in the unit for less than the cost of what it would be for a Luthier to replace the frets in a guitar.

While embodiments depicted herein relate to guitars, it shall be understood that other stringed instruments, both acoustic and electric, such as guitars, violins, cellos, banjos, and other stringed instruments are contemplated in one or more embodiments. Moreover, it is understood that the components in the figures are not necessarily to scale, with emphasis instead being placed upon illustrating the principals of one or more embodiments. Like reference numerals designate corresponding parts throughout the different views. Embodiments are illustrated by way of example and not limitation in the figures of the accompanying drawings. The following detailed description contains many specifics for the purposes of illustration, but a person of ordinary skill in the art will appreciate that many variations and alterations to the following details are within the scope of the invention. Accordingly, the following embodiments of the invention are set forth without any loss of generality to, and without imposing limitations upon the claimed invention.

With respect to FIG. 1, a musical instrument 100 with interchangeable parts is shown. In one embodiment, the musical instrument 100 is an electric guitar. The musical instrument 100 may have a modular design providing for customization to a user's preferences. In one or more embodiments, a user may customize a head stock style, the left-right handedness, the neck thickness, the scale length, the body style, electronics, and the like. In an embodiment, the musical instrument 100 is made of aluminum. The aluminum construction of the musical instrument 100 allows for the lightening of the instrument by pocketing. Pocketing is helpful to produce resonance chambers similar to an acoustic guitar. Resonance chambers encourage vibration and sustain action in a guitar.

As shown in FIG. 1, a coordinate system is introduced which is consistent with the embodiments depicted herein in the figures. A coordinate system comprises an x-axis 16, which is parallel or longitudinal with the length of the strings and the neck of the guitar 100, a y-axis 14, which is perpendicular or lateral with respect to the length of the strings 10 or neck, and a z-axis 12, which is perpendicular with respect to both the x-axis and the y-axis and refers to a vertical direction.

Figure 2:
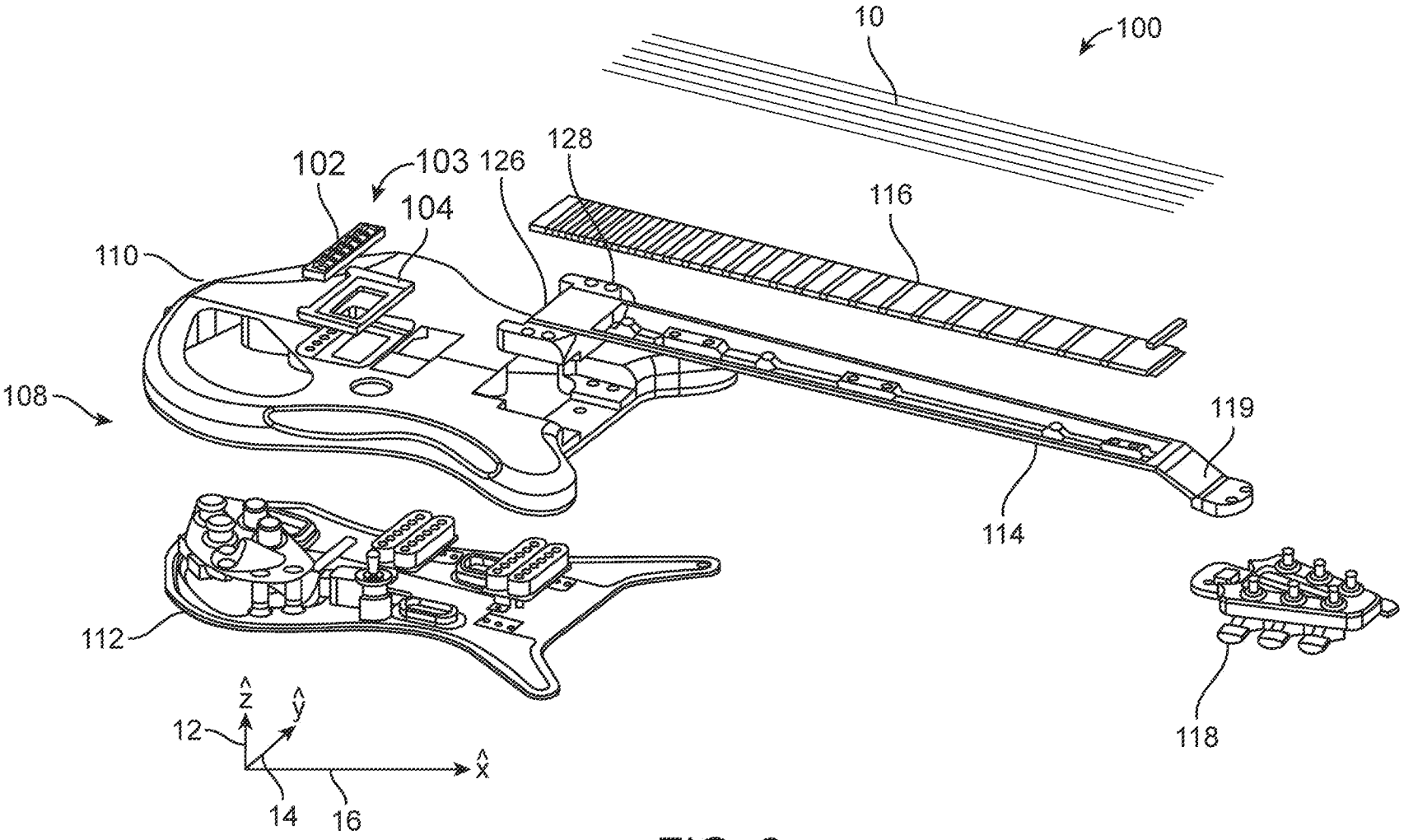
FIG. 2 is a perspective, exploded view of the stringed musical instrument.

FIG. 2 is a perspective, exploded view of the musical instrument shown in FIG. 1. In an embodiment, the modular stringed instrument 100 (guitar) comprises a body 108 having a top portion 110 and a bottom portion 112, a bridge assembly 103 comprising a bridge 102 and a bridge plate 104, a neck 114 detachably coupled to the top portion 110 of the body 108, a neck head 118 detachably coupled to the neck 114, and a plurality of strings 10. The musical instrument 100 has a modular design that includes a body 108 with a top portion 110 and a bottom portion 112 with drop-out electronic components. The musical instrument 100 further includes a neck 114 with a detachable fretboard 116 and a detachable neck head 118.

Figure 3:
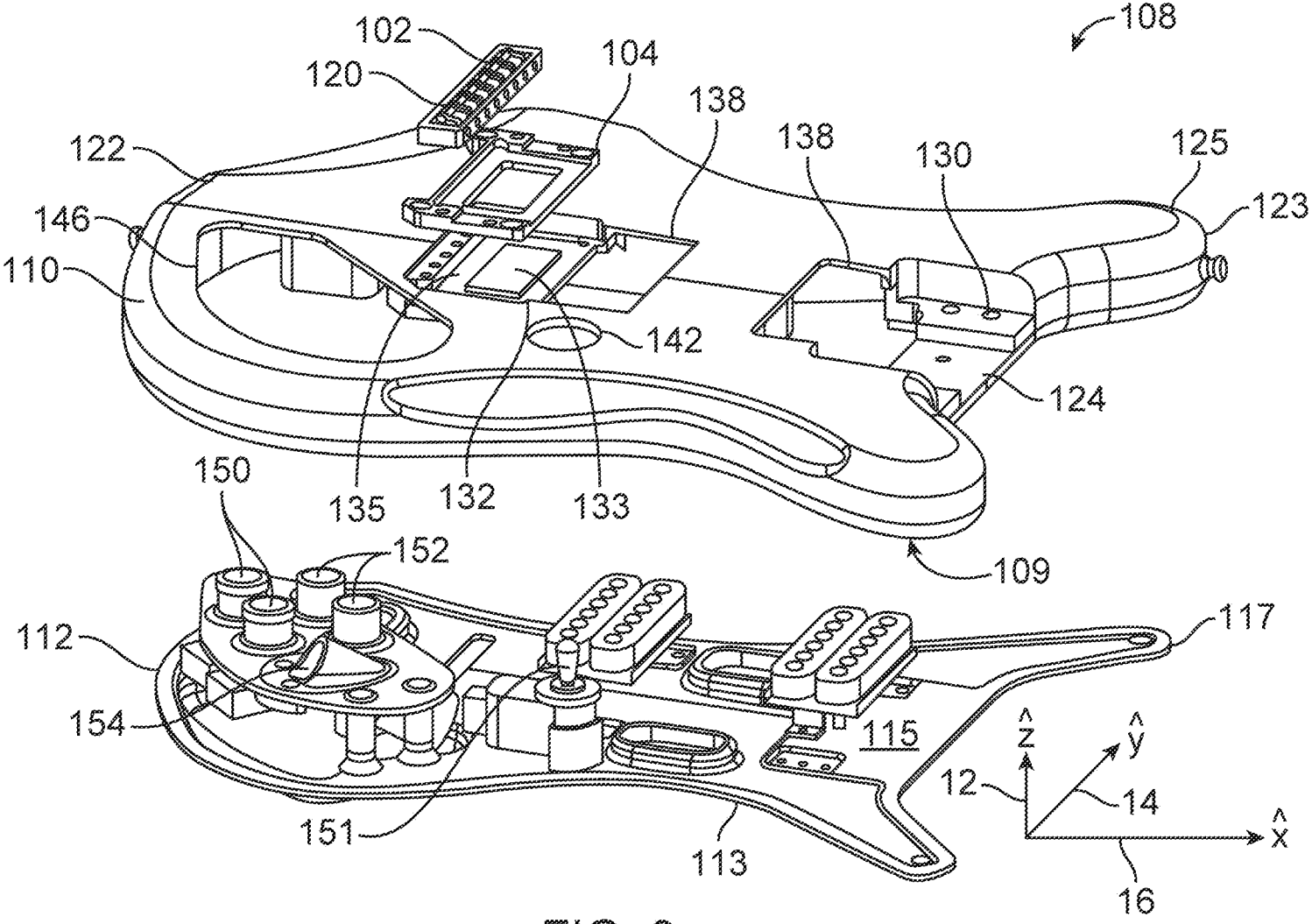
FIG. 3 is a perspective, exploded view of a body of the stringed musical instrument.

FIG. 3 is a perspective, exploded view of a body 108 of the musical instrument 100 of FIG. 1. The bottom portion 112 of the body 108 has a generally flat rear surface 113 and a bottom portion perimeter 117. The bottom portion has an inner surface 115 opposite the generally flat rear surface 113. The inner surface 115 supports instrument electronics (150, 152, 154, and 151) that extend upward (vertically, parallel with the z-axis) away from the inner surface 115. The electronics may include volume knobs 150, tone knobs 152, an output jack 154, and a selector 151.

The top portion 110 of the body 108 has a face 122 and vertical walls 123 extending downward (vertically, parallel with the z-axis) from an outermost perimeter 125 of the face 122. The top portion 110 is configured to receive and detachably couple with the bottom portion 112. The vertical walls 123 of the top portion 110 engage with the bottom portion perimeter 117. The top portion 110 and the bottom portion 112 form an inner cavity 109. The top portion 110 has a plurality of apertures (138, 142, 146) for receiving the bridge assembly 103 and instrument electronics (150, 151, 152, 154) of the bottom portion 112. Specifically, aperture 138 enables the bridge assembly 103 to couple to the top portion 110, aperture 142 receives the selector 151, and aperture 146 receives and provides access to volume knobs 150, tone knobs 152, and an output jack 154. The top portion 110 has a neck receiving portion 124 and a bridge assembly receiving portion 132.

The bridge assembly 103 comprises a bridge 102 and a bridge plate 104, where the bridge plate 104 is detachably coupled to the bridge 102 and the bridge plate 104 is detachably coupled to the bridge receiving portion 132 of the top portion of the body.

The bridge assembly receiving portion 132 and the bridge plate 104 are shaped to mate and interlock, and to precisely position the bridge plate 104 to the top portion 110. In an embodiment, the bridge assembly receiving portion 132 has one or more nonplanar features. The bridge plate 104 is shaped to be inversely contoured to the nonplanar features of the bridge assembly receiving portion 132. During assembly, the bridge plate 104 receives and interlocks with the bridge assembly receiving portion 132 such that the bridge assembly receiving portion 132 is shaped to precisely position and secure the bridge plate 104 on the top portion 110 of the body 108. In an embodiment, the bridge plate 104 is secured both longitudinally (i.e. parallel with the strings or x-axis) and laterally (i.e. perpendicular with the strings or y-axis).

In one or more embodiments, the one or more nonplanar features of the bridge assembly receiving portion 132 comprises a flat surface 135 and a raised surface 133, and the bridge plate 104 is contoured to have an inner aperture that is shaped to receive the raised surface 133 of the bridge assembly receiving portion 132. In an embodiment, both the raised surface 133 and the aperture are rectangular and are formed to detachably couple such that top portion 110 securely registers and positions the bridge plate 104 in place.

The interchangeable parts of the musical instrument 100 allow for the musical instrument 100 to be set up properly (and easily) out of the box. The interchangeable parts of the musical instrument 100 may be fastened and secured together with changeable mechanical fasteners, such as screws, thus eliminating the need for a luthier to construct the musical instrument 100. The proper setup of the instrument 100 is provided by the precise control of key geometric features, such as a bridge 102, a bridge plate 104, and a nut 106. The bridge 102 may have adjustable claw pads 120 (see FIG. 3) for each string to allow for micro-adjustments of each bridge saddle, such as forward, back, up, and down, as described in further detail below. The bridge plate 104 may control the height of the bridge 102 and the exact scale length of the entire bridge placement. Traditionally, luthiers hand file nuts and hand place bridges on an instrument to properly set up the instrument for optimal sound quality. However, the results can vary from luthier to luthier and it is a challenge to repeat a desired sound quality from instrument to instrument. The present musical instrument 100 facilitates the guitar set up for a user that merely has to set individual intonation on each string and the action (e.g., string height) at the bridge 102.

The Body

Figure 4B:
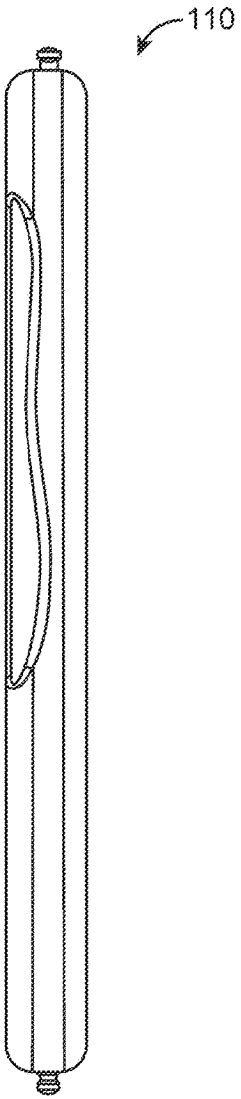
FIG. 4B is a side view of the body of the stringed musical instrument.

As discussed above, FIG. 2 shows the body 108 with the top portion 110 and the bottom portion 112 detached from one another. With respect to FIGS. 3 and 4, the top portion 110 is shown in further detail. More specifically, a face 122 of the top portion 110 may include a first receiving portion 124 for receiving a base portion 126 of the neck 116 (see FIG. 2). The base portion 126 may have holes 128 that align with holes 130 of the first receiving portion 124 for securing the neck 116 to the top portion 110 with screws. The top portion 110 may further include a second receiving portion 132 for receiving the bridge 102 and the bridge plate 104. The bridge plate 104 may have holes 134 that align with holes 136 of the second receiving portion 134 for securing the bridge plate 104 (see FIG. 12) to the top portion 110 with screws.

With respect to FIGS. 4-8, the top portion 110 may further include openings 138 for accommodating electronic components of the bottom portion 112. In one embodiment, the openings 138 each accommodate a pickup 140. An opening 142 of the top portion 110 may accommodate additional electronic components of the bottom portion 112, such as a selector 151. An opening 146 of the top portion 110 may also accommodate additional electronic components of the bottom portion 112, such as a plate 148 that may include a variety of electronic components, such as volume knobs 150, tone knobs 152, and an output jack 154

The bottom portion 112 with the drop out electronic componentry (e.g., pickups 140, volume knobs 150, tone knobs 152, output jack 154, potentiometers, capacitors, and a three-way switch) allow the electronics to be installed and customized to change the tone without having to leave the musical instrument 100 with a technician or aluthier. Furthermore, it is not required to remove the strings of the musical instrument 100 in order to change out all the electrical componentry. In one embodiment, the bottom portion 112 may be replaced with another pre-made bottom portion with a different electrical set up, such as different pickups. In one embodiment, the pickups 140 are lace pickup alumitones. Lace pickups may vary from standard pickups due to the fundamental design of the pickup. Standard pickups use current to control wire wraps which control tone. In contrast, the lace alumitones use voltage to control wire wraps. Lace alum itone pickups may be lighter than standard pickups.

Figure 6:
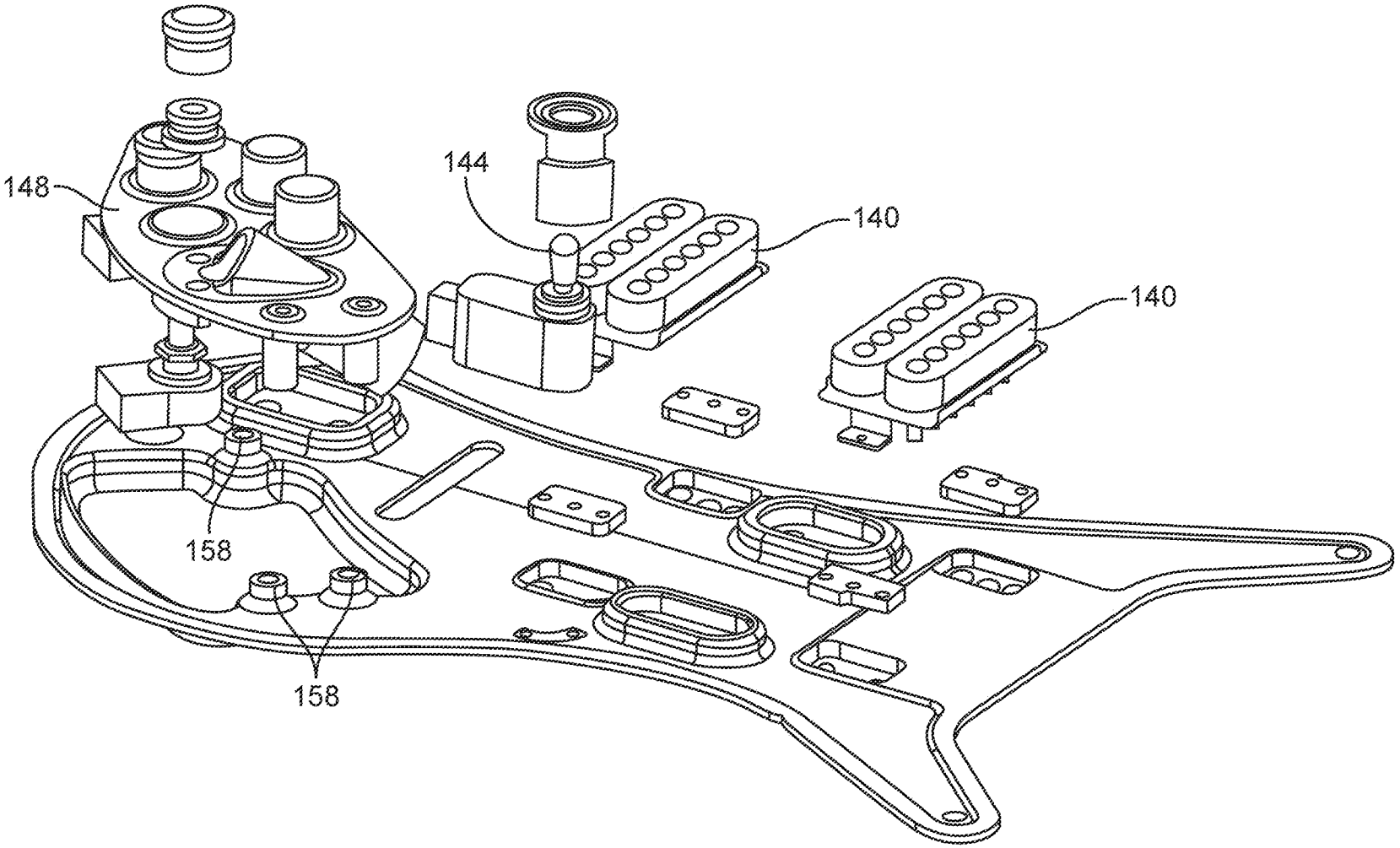
FIG. 6 is a perspective, exploded view of the bottom portion of the stringed musical instrument.
Figure 7:
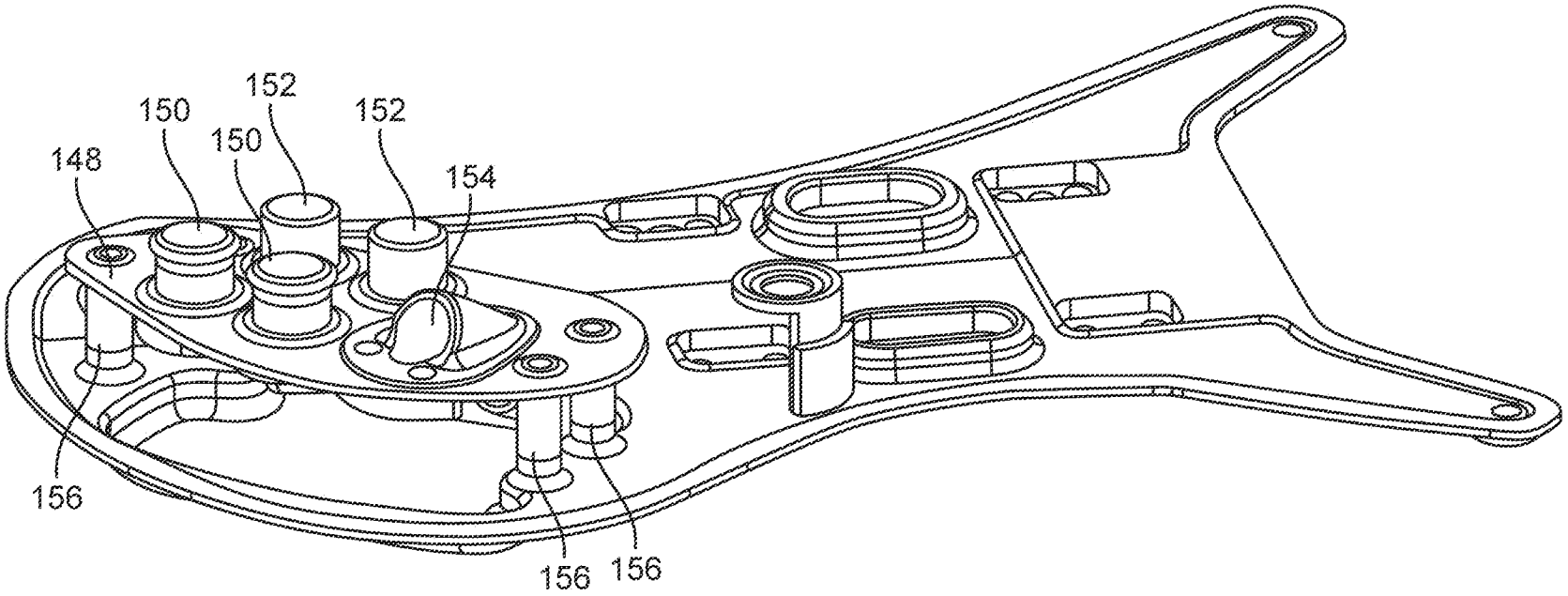
FIG. 7 is a perspective view of the bottom portion of the stringed musical instrument.

With respect to FIGS. 6-8, the plate 148 may have support pillars 156 to allow the plate 148 to fit seamlessly into the hole 146 and sit flush with the face 122 of the top portion 110. This also allows the electronic components to extend through the hole 146 of the top portion 110 giving a user easy access to the electronic components. In an embodiment, the pillars 156 align with holes 158 of the bottom portion 112. Screws may be fed through the pillars 156 and into the holes 158 to secure the plate 148 to the bottom portion 112.

Figure 8B:
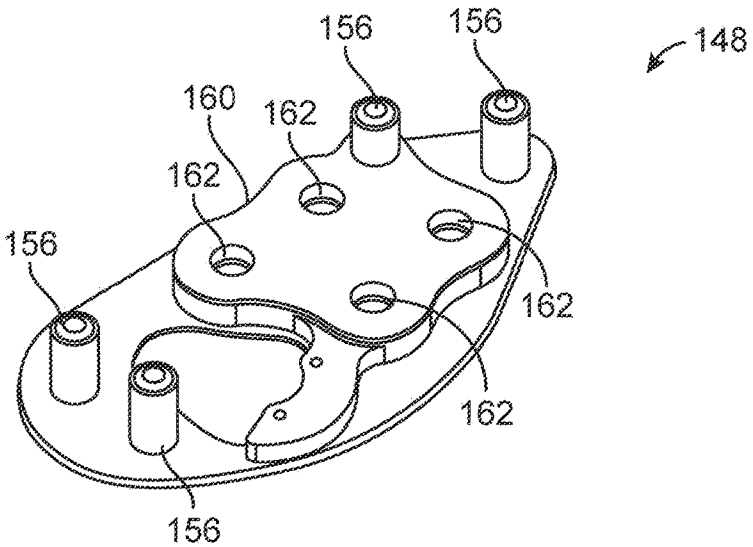
FIG. 8B is a bottom, perspective view of a plate associated with the bottom portion.
Figure 8D:
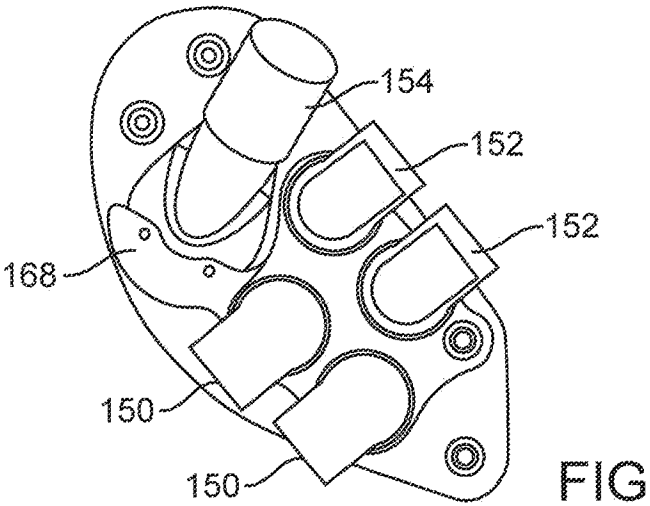
FIG. 8D is a bottom perspective view of a plate associated with the bottom portion showing the electronic components.
Figure 8A:
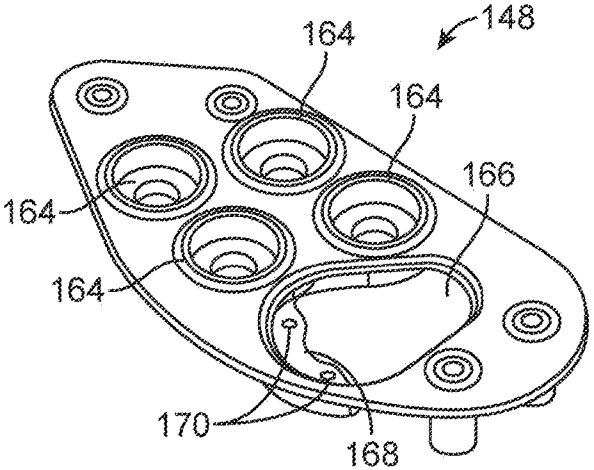
FIG. 8A is a top, perspective view of a plate associated with the bottom portion.
Figure 8C:
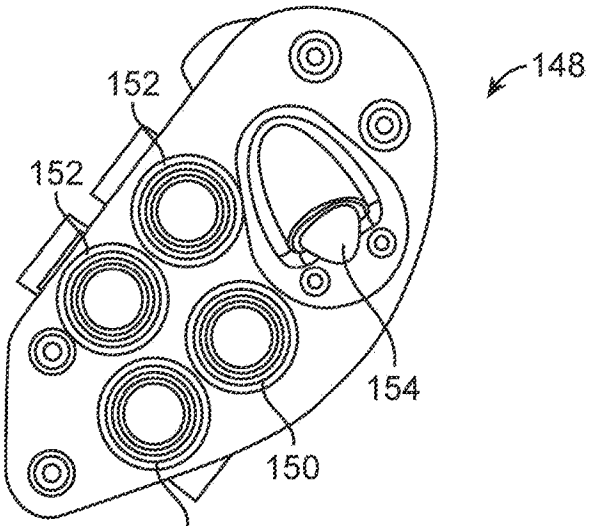
FIG. 8C is a top, perspective view of a plate associated with the bottom portion showing the electronic components.

FIGS. 8A and 8B show the top side of the plate 148 and the bottom side of the plate 148, respectively, without the electronic components. FIGS. 8C and 8D show the top side of the plate 148 and the bottom side of the plate 148, respectively, with the electronic components inserted and fastened to the plate 148. More specifically, the underside of the plate 148 may have a platform 160 with holes 162 leading to openings 164 on the top side of the plate 148 for receiving electronic components, such as the volume knobs 150 and the tone knobs 152. The plate 148 may also have an opening 166 with a ridge 168. The output jack 154 may be inserted into the opening 166 and secured to the plate 148 by fastening the output jack 154 to the ridge 168 with a pair of screws threaded into holes 170 of the ridge 168.

Figure 9:
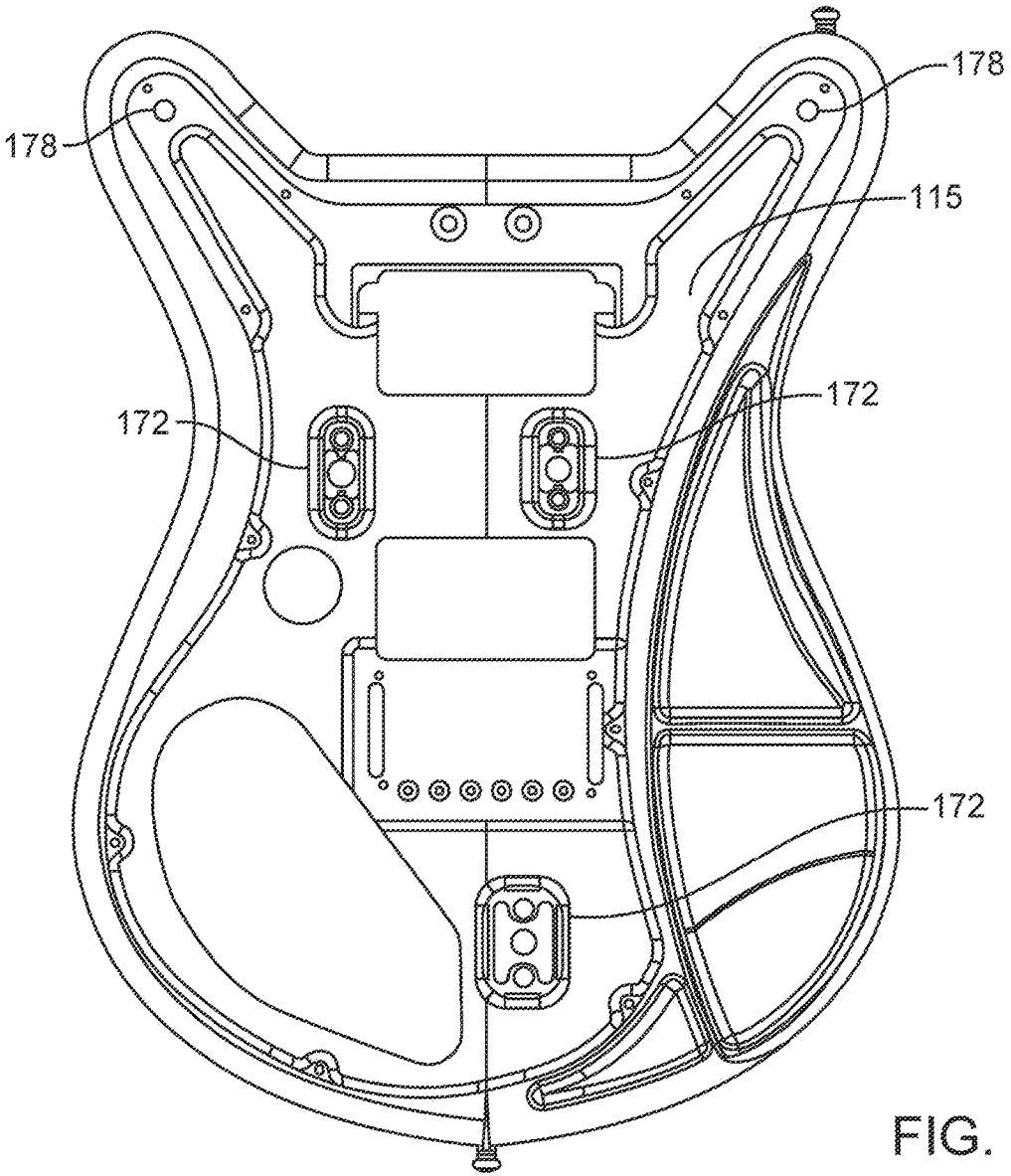
FIG. 9 is view of the underside of the top portion.

With respect to FIGS. 9-11, securing of the top portion 110 of the body 108 to the bottom portion 112 is shown in further detail. More specifically, FIG. 9 shows the inside of the top portion 110, where the top portion 110 includes three towers 172. With respect to FIGS. 10A-10C, the inside of the bottom portion 112 of the body 108 is shown in FIG. 10A, and the outside of the body portion 112 of the body 108 is shown in FIG. 10C. FIG. 10B shows an edge-on view of the bottom portion 112. The bottom portion 112 may include three receiving portions 174 for receiving the towers 172 of the top portion 110. In one embodiment, the three receiving portions 174 are indentations in the bottom portion 112 sized for allowing the towers 172 to be attached to the receiving portions 174. In one embodiment, the towers 172 are secured to the receiving portions 174 with screws.

Figure 11A:
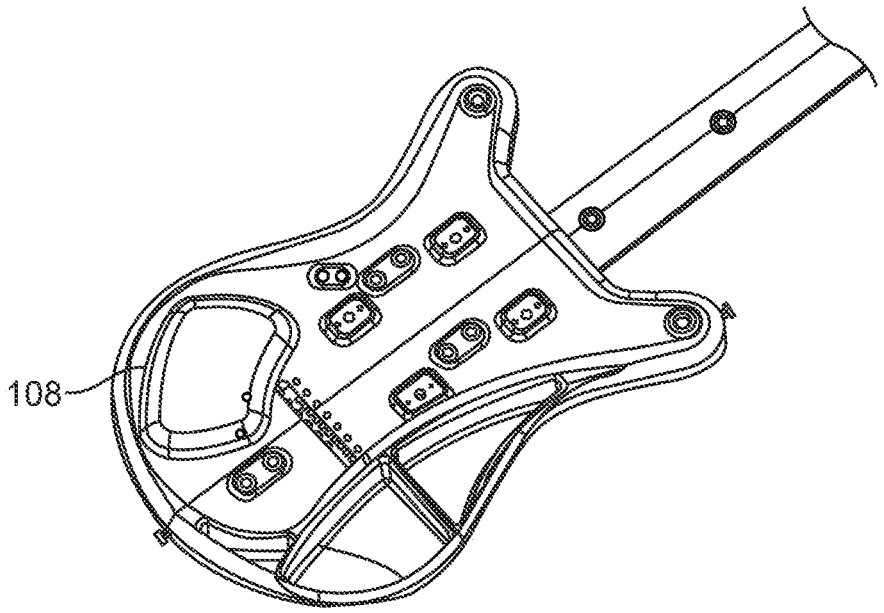
FIG. 11A is a view of the stringed musical instrument 1 with the bottom portion attached to the body.
Figure 11B:
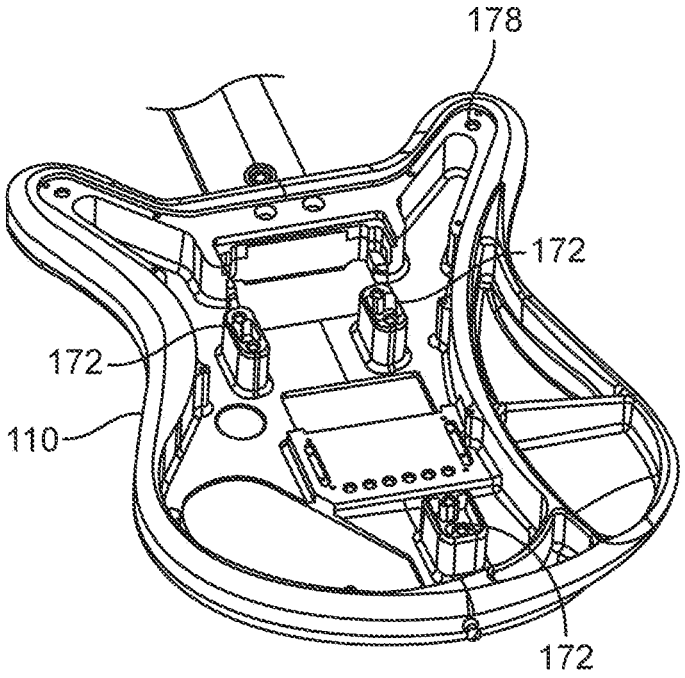
FIG. 11B is a view of the stringed musical instrument with the bottom portion detached from the body.

FIG. 11A shows the underside of the musical instrument 100 with the bottom portion 112 attached to the top portion 110, while FIG. 11B shows the bottom portion 112 removed from the musical instrument 100. In one embodiment, two screws secure the bottom portion 112 and the top portion 110 together. More specifically, each screw may be threaded through a hole 176 of the bottom portion 112 (see FIG. 10) and into a hole 178 of the top portion 110 (see FIG. 9). The hollowed-out aluminum construction of the instrument 100 shown in FIG. 11 allows for the lightening of the instrument 100 by "pocketing" such as by forming pockets (not numbered). Pocketing may be helpful to produce resonance chambers similar to an acoustic guitar. In one embodiment, resonance chambers encourage vibration and sustain action in a guitar.

The Bridge

Figure 12:
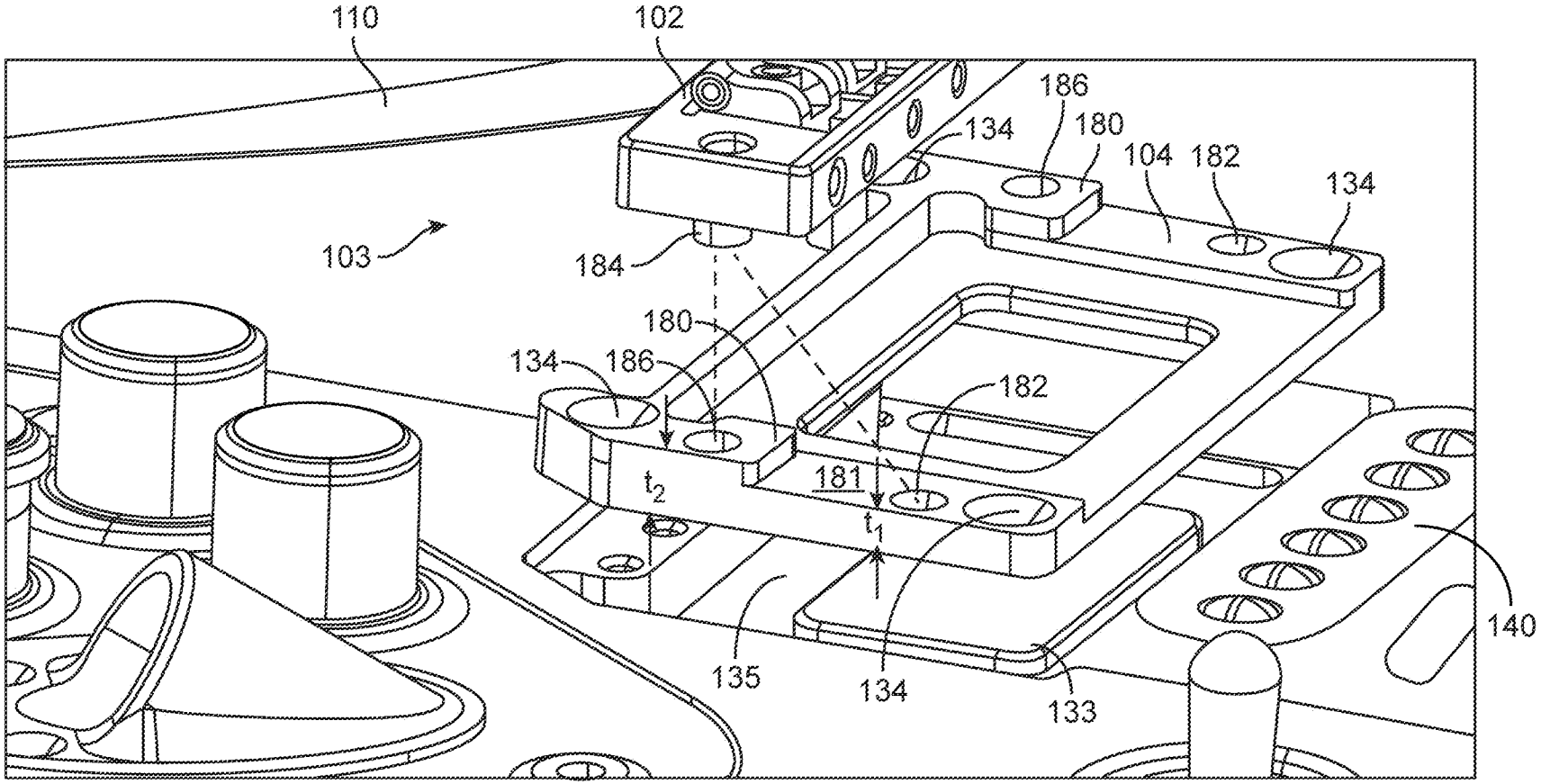
FIG. 12 depicts a perspective, exploded view of a bridge and a bridge plate associated with the stringed musical instrument.
Figure 13:
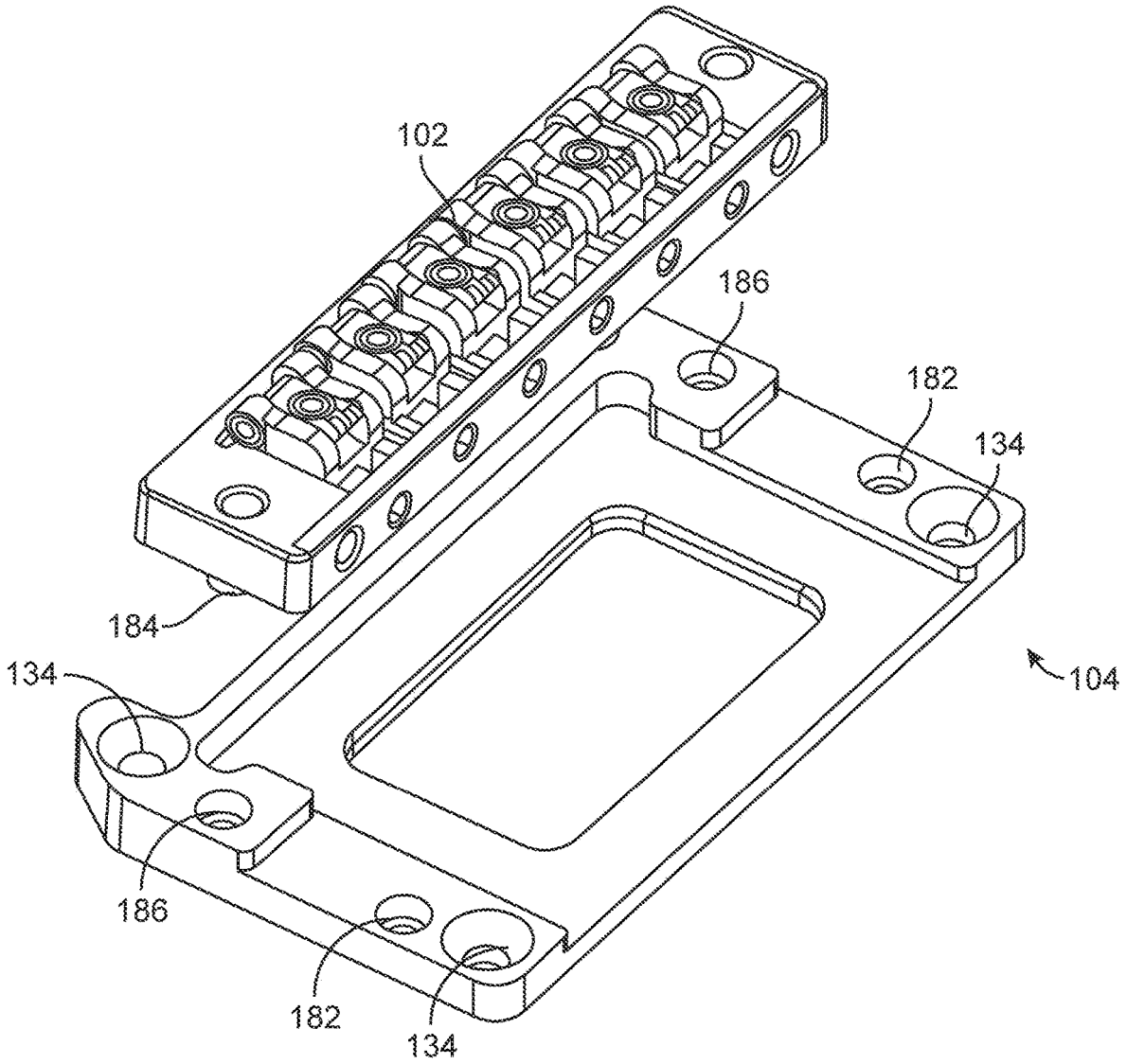
FIG. 13 is a perspective, exploded view of the bridge and the bridge plate.
Figure 14A:
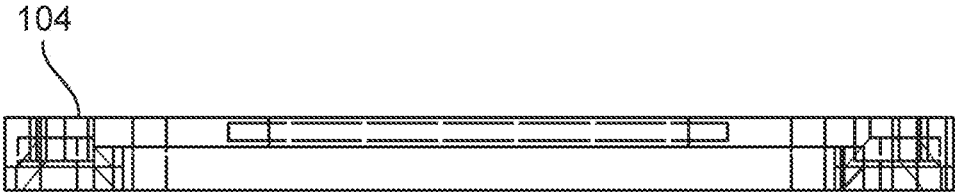
FIG. 14A is a side elevation view of the bridge plate.
Figure 14B:
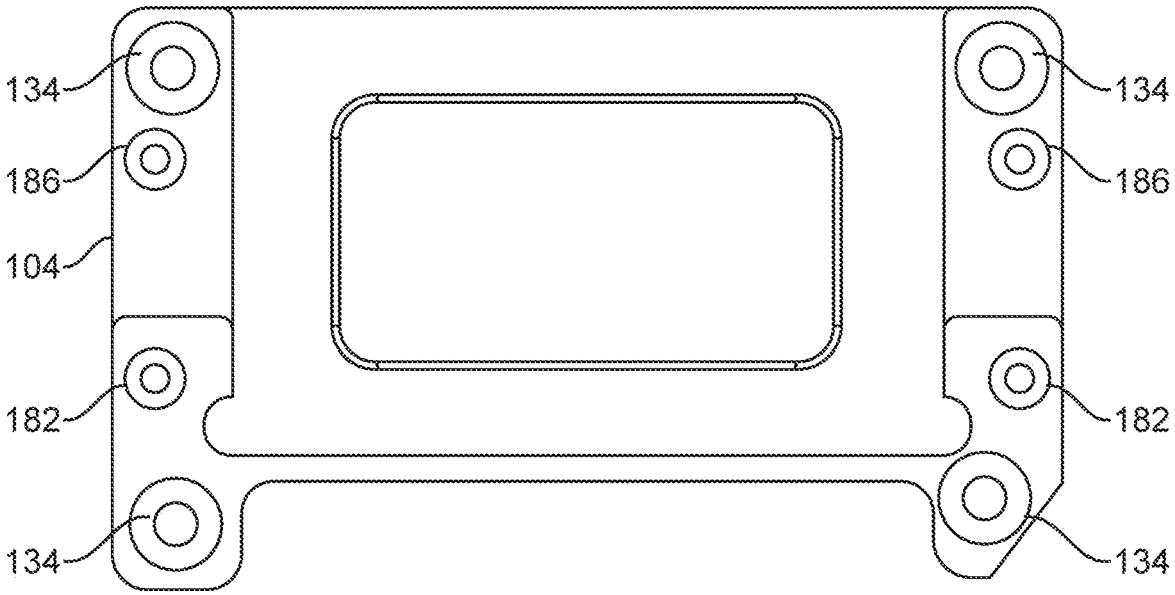
FIG. 14B is a top view of the bridge plate.

With respect to FIGS. 12-14, the bridge assembly 103 comprising the bridge 102 and bridge plate 104 is shown in further detail. In one embodiment, the bridge 102 with the bridge plate 104 may allow for analog placement of the bridge 102 along the bridge plate 104. The bridge plate 104 may be custom machined to accommodate a user's preferences. In an embodiment, different bridge plates 104 may be interchangeable providing for an adjusted bridge 102 position and/or thickness with each bridge plate 104 used. Strings of the instrument 100 attach to the bridge 102 and each string height is adjustable. As described above, the bridge plate 104 has holes 134 that align with holes 136 of the second receiving portion 134 of the top portion 110 (best shown in FIG. 4A) for securing the bridge plate 104 to the top portion 110 with screws.

The bridge plate 104 may have a step 180 on each side of the bridge plate 104, providing for a larger thickness at the rear of the bridge plate 104. Specifically, the bridge plate 104 comprises a first surface 181 having a first thickness $t_1$ and a raised step 180 having a second thickness $t_2$, where $t_2$ is greater than $t_1$. The bridge 102 may be coupled to the bridge plate 104 on the first surface 181 or coupled to the raised step 180.

The thinner portion of the bridge plate 104 may have two post holes 182, with each post hole 182 receiving a post 184 of the bridge 102. The bridge 102 may then be secured to the bridge plate 104 by threading screws through the posts 184 and into the post holes 182. In another embodiment, the posts 184 may be similarly secured to the thicker portion of the bridge plate 104 at post holes 186 of the thicker portion of the bridge plate 104.

Figure 15A:
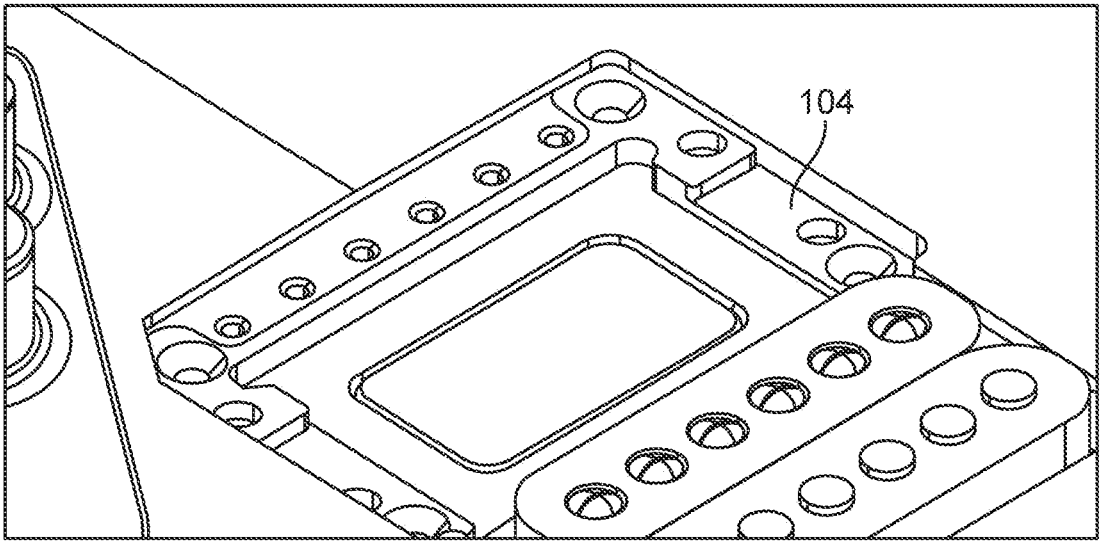
FIG. 15A is a perspective views of the bridge.
Figure 15B:
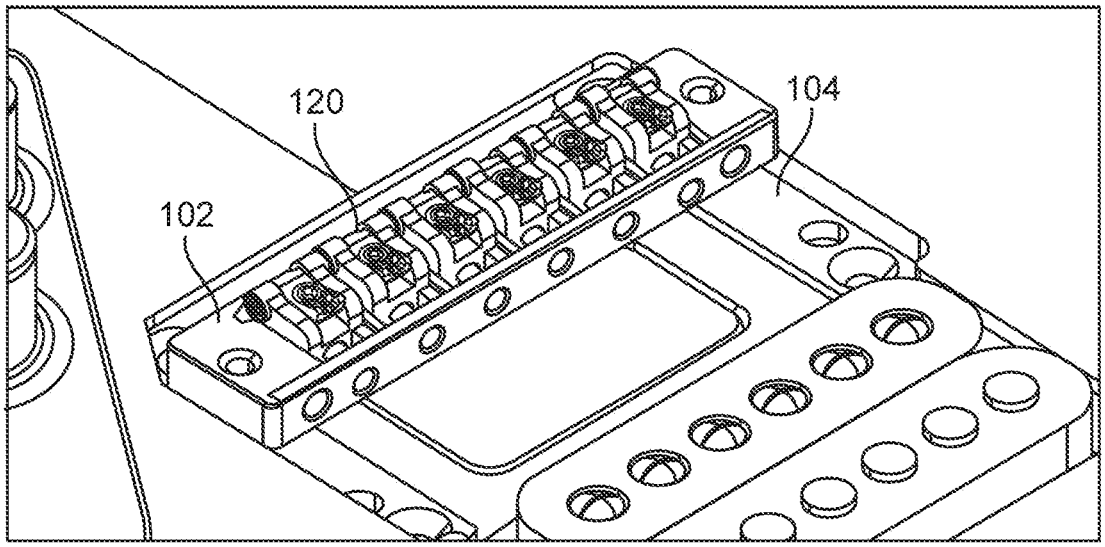
FIG. 15B is a perspective view of the bridge connected to the bridge plate.

In one or more embodiments, the post holes 182 and 186 receive the posts 184 and securely registers and positions the bridge 102 in place in either one of two desired locations. In an embodiment, the bridge 102 is secured to the bridge plate 104 both longitudinally (i.e. parallel with the strings or x-axis) and laterally (i.e. perpendicular with the strings or y-axis). FIG. 15A shows the bridge plate 104 secured to the top portion 110 of the body 108, and FIG. 15B shows the bridge 102 secured to the bridge plate 104.

In one or more embodiments, the modular instrument 100, with the bridge 102 placed at an optimum height for the lowest possible action of the strings without "buzzing" on the fretboard 116. Generally speaking, buzzing may occur when a string vibrates in an ovular frequency shape and makes contact with the fretboard 116. A higher action may be achieved by interchanging the bridge plate 102 with a thicker bridge plate and/or raising the claw pads 120.

The purpose of the bridge plate 104 is to set the overall action on the strings. A real and recurring issue in setting up guitars is that the height of the bridge is hard to set. And, when people buy certain types of bridges, a luthier has to shim up the bridge to to give the buyer what they want. So, here, the inventor machined the pocket into the body that is pretty deep so you can raise up the bridge to where you want it. The whole idea on the bridge plate 104 is to get you very close to what you want, and then make micro-adjustments with the claw pads 120 that are carried by the bridge 102 held by the bridge plate 140. What you have with this bridge plate 104 is the ability to get close to where you want, without need of a luthier, and then use the claw pads to make micro-adjustments.

Figure 16A:
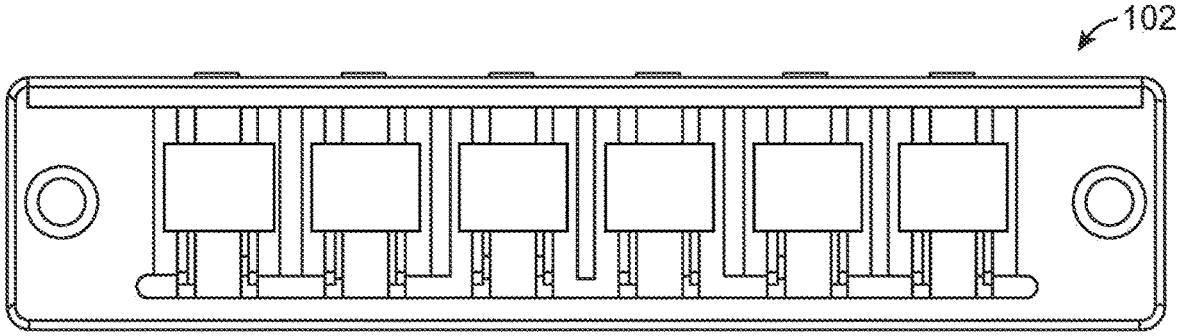
FIG. 16A is a bottom view of the bridge.
Figure 16B:
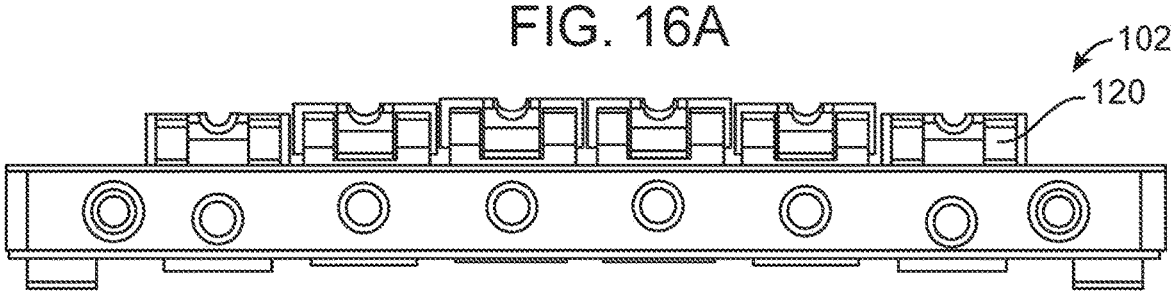
FIG. 16B is a side elevation view of the bridge.
Figure 16C:
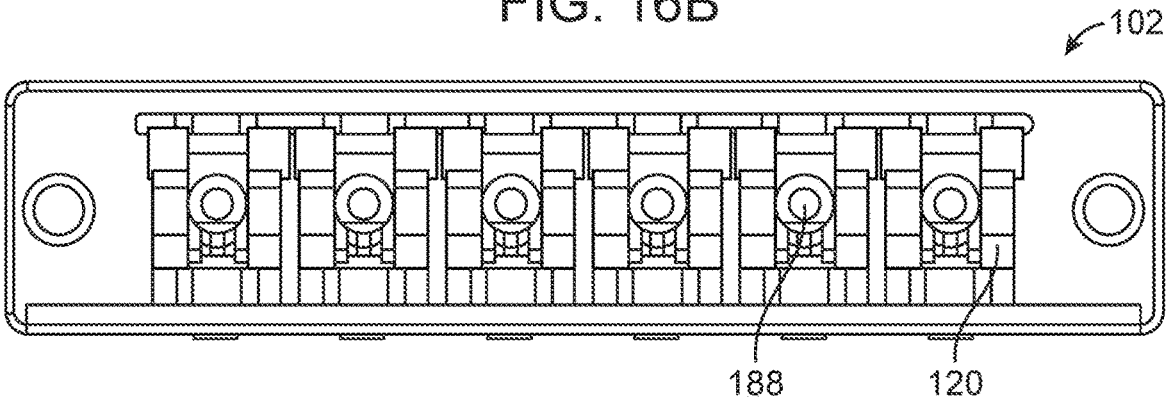
FIG. 16C is a top view of the bridge.
Figure 17:
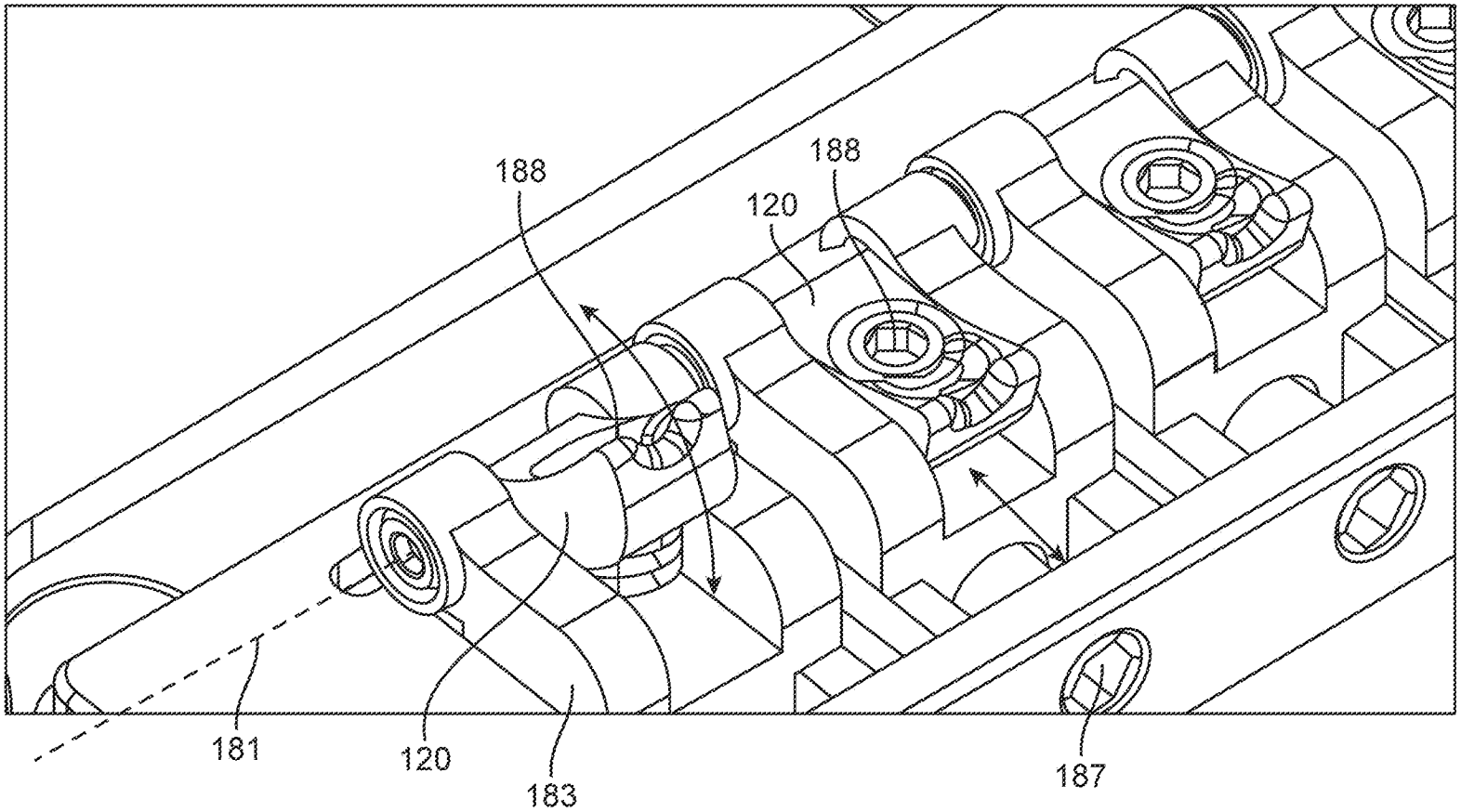
FIG. 17 is a perspective view of the bridge.
Figure 18:
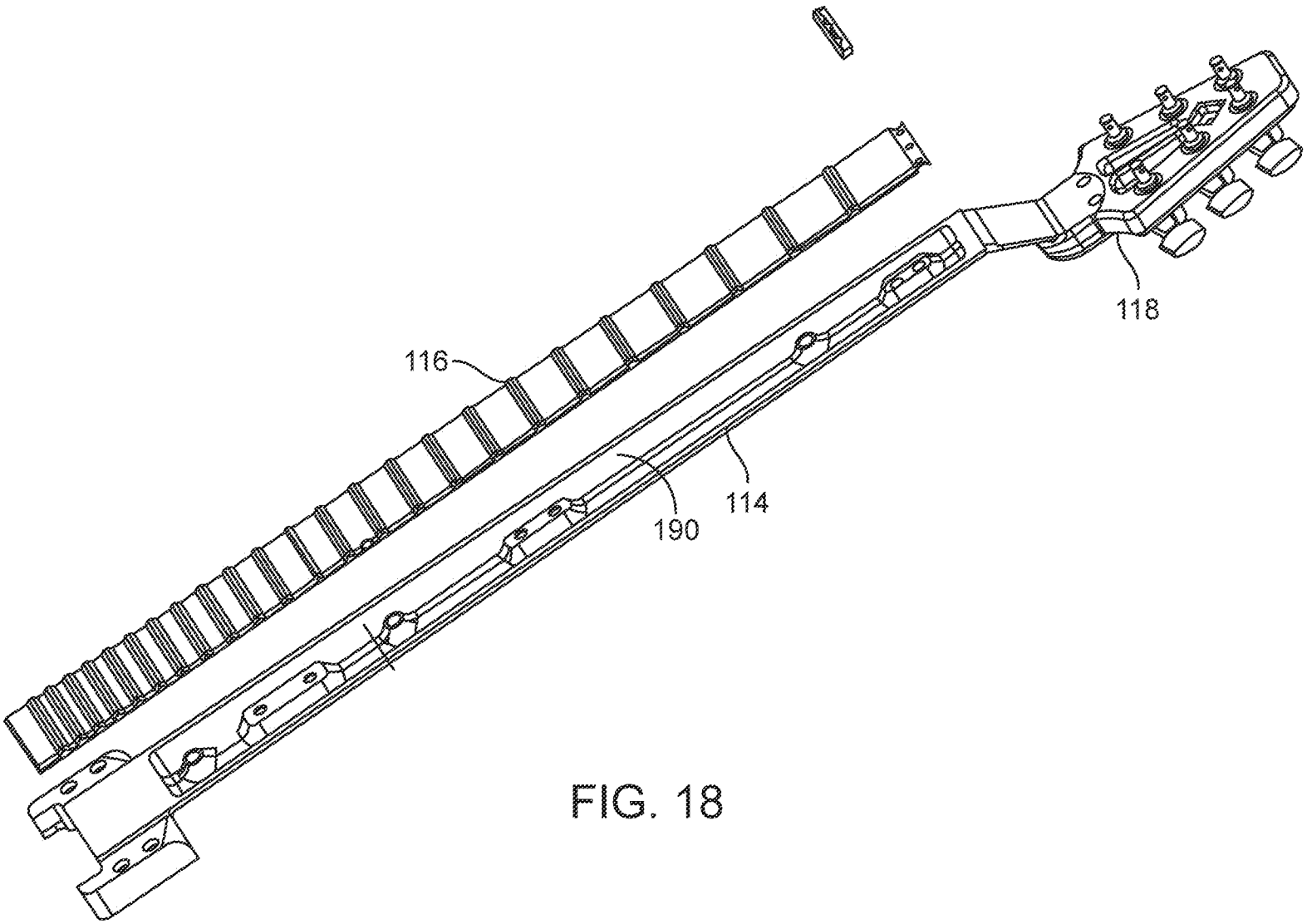
FIG. 18 is an exploded view of a neck, a neck head, and a fretboard associated with the stringed musical instrument.
Figure 19A:
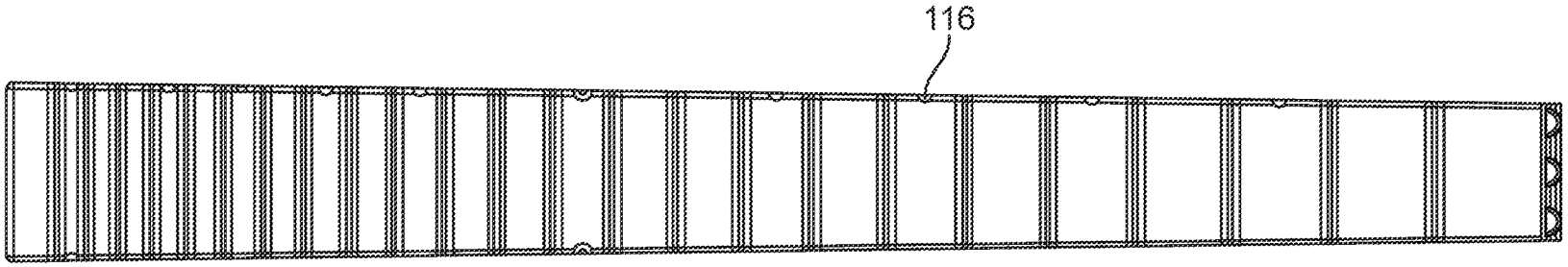
FIG. 19A is a top view of the fretboard.
Figure 19B:
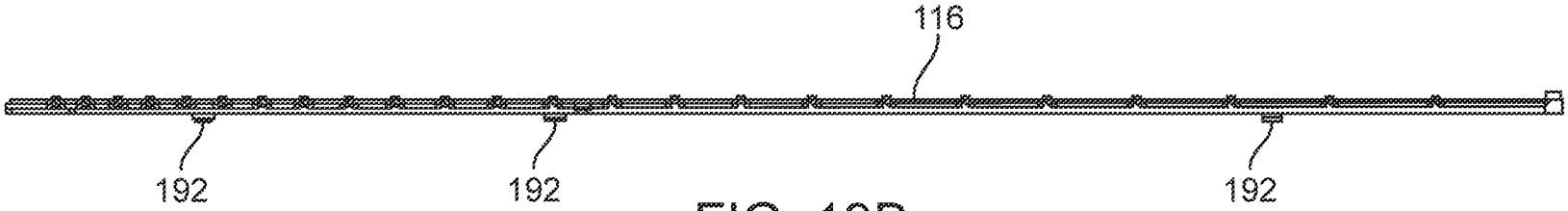
FIG. 19B is a side elevation view of the fretboard.
Figure 19C:
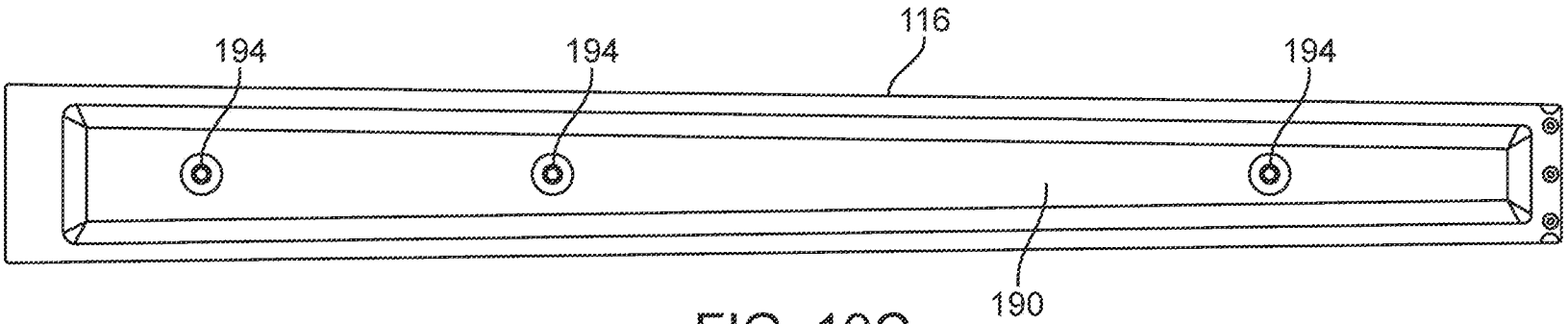
FIG. 19C is a bottom view of the fretboard.
Figure 20A:
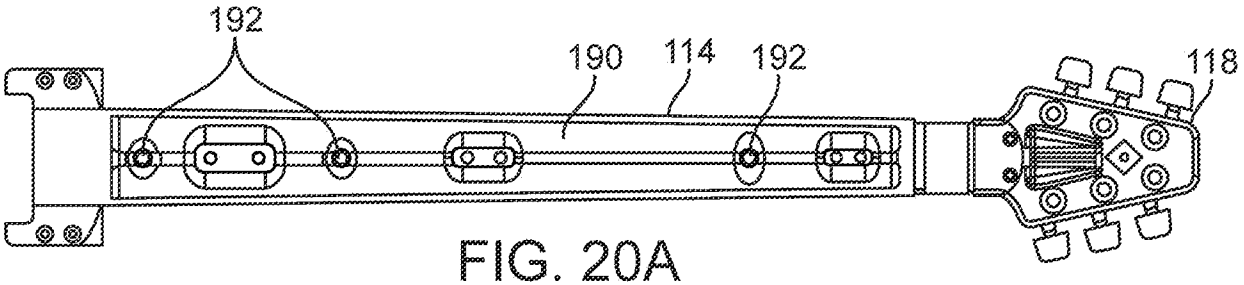
FIG. 20A is a top view of the neck and neck head.
Figure 20C:
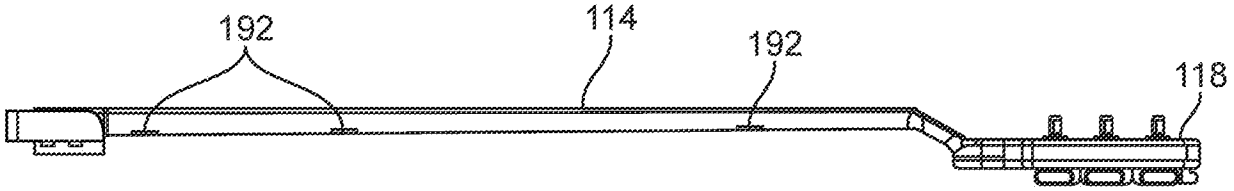
FIG. 20C is a side elevation view of the neck and neck head.
Figure 20D:
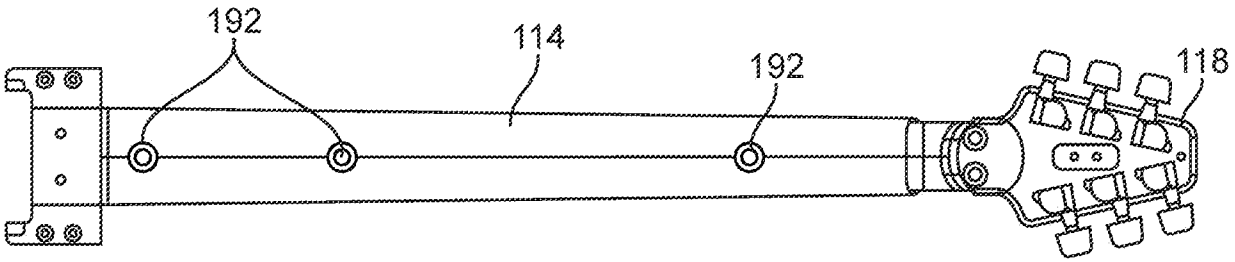
FIG. 20D is a bottom view of the neck and neck head.
Figure 20B:
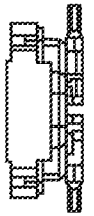
FIG. 20B is a bottom, elevation view of the neck and neck head.
Figure 21:
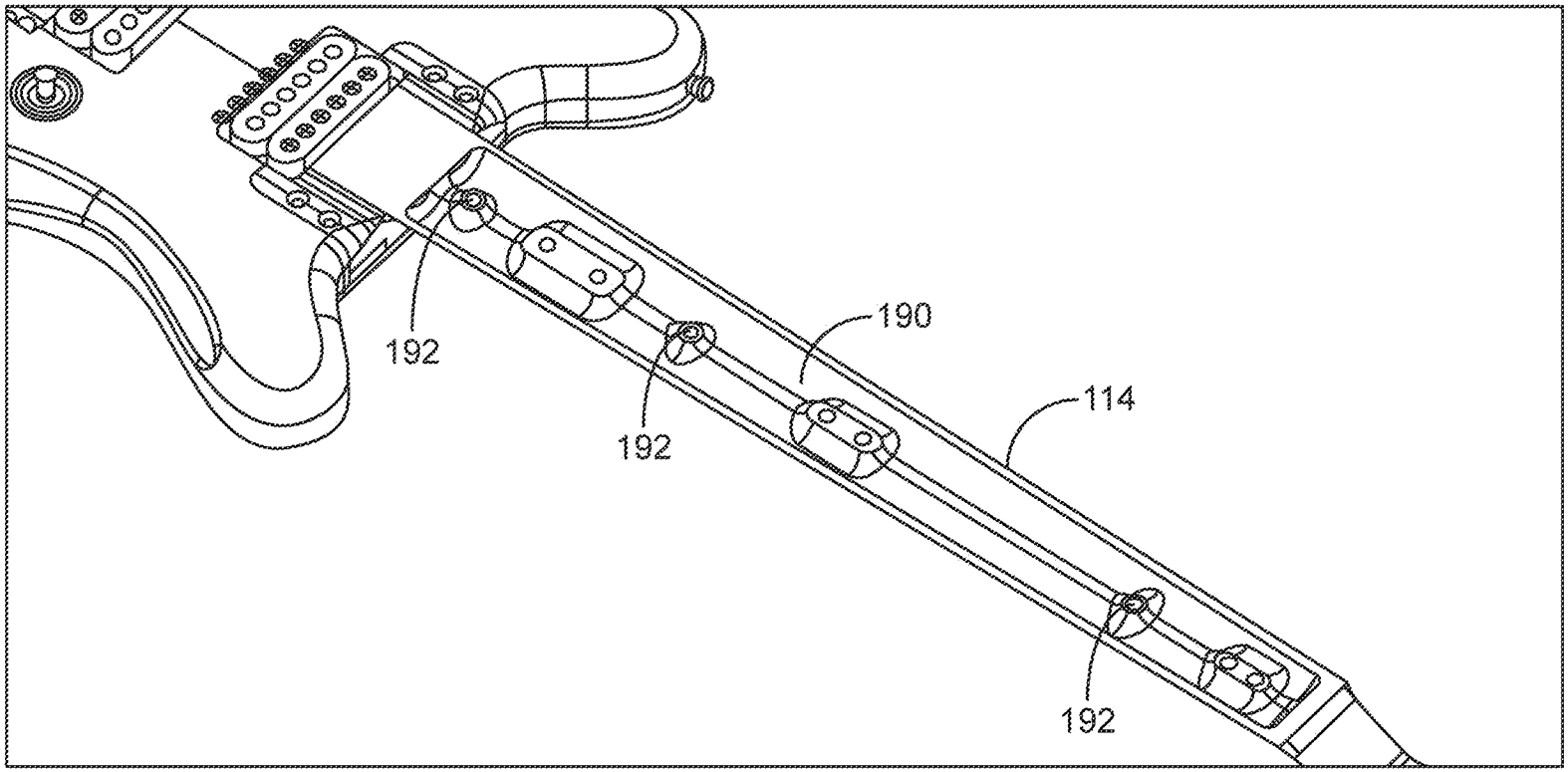
FIG. 21 is a top perspective view of the neck.
Figure 22:
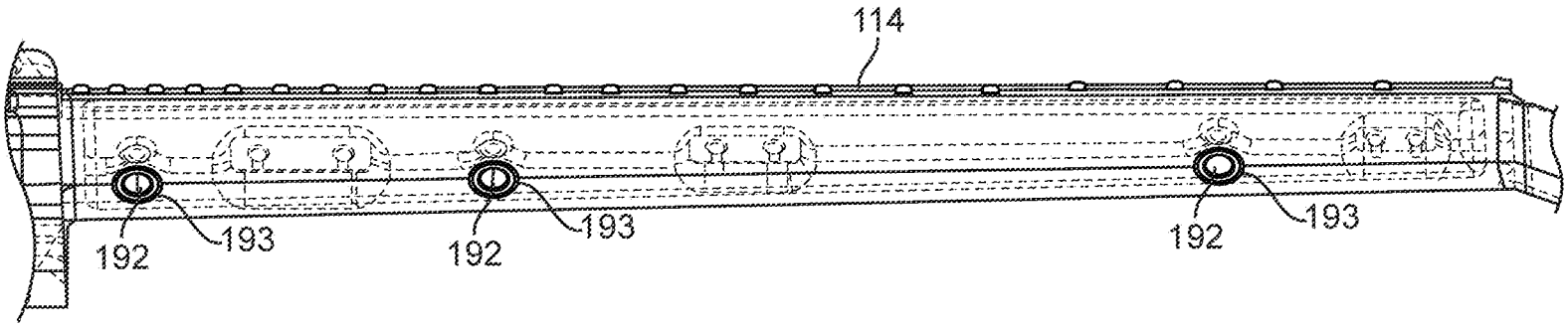
FIG. 22 is a bottom, sectional view of the neck.

More specifically, and with respect to FIGS. 16 and 17, each claw pad 120 has a set screw 188 that may be individually adjusted for optimum action for each string height. As shown in FIG. 17, turning the screw 188 raises vertically (and lowers) as well as rotating the claw pad 120 about an axis 181. Turning screw 187, by contrast, moves the claw assembly 183 back and forth longitudinally or parallel with respect to the length of the strings.

In one embodiment, individual adjustments may be made for each string. Individual adjustments may allow for the use of different gauge (e.g., different diameter) strings and for individual strings to move up and down, while bringing in the intonation. As the individual string length changes, the height must change along with the forward and back position for optimal string action and correct tuning. Being able to adjust the exact location of the bridge 102 with the bridge plate 104 allows a user to quickly and easily change the tuning of the instrument 100 into "drop D" mode (e.g., Drop D tuning is when a guitar's 6th string is tuned down from an E to a D) and other alternate tuning modes. The modularity and construction of the musical instrument 100 provides for easy and simple changing of global attributes of scale length and tuning. Being able to easily change global attributes of scale length and tuning in a way that makes sense engineering wise. Embodiments of the aluminum electric guitar provide the musician in a manner that accommodates any preference that he may have is unique.

Alternative Bridge Plate

In other embodiments, the bridge plate may be provided in alternative forms that provide even more adjustability.

Figure 29:
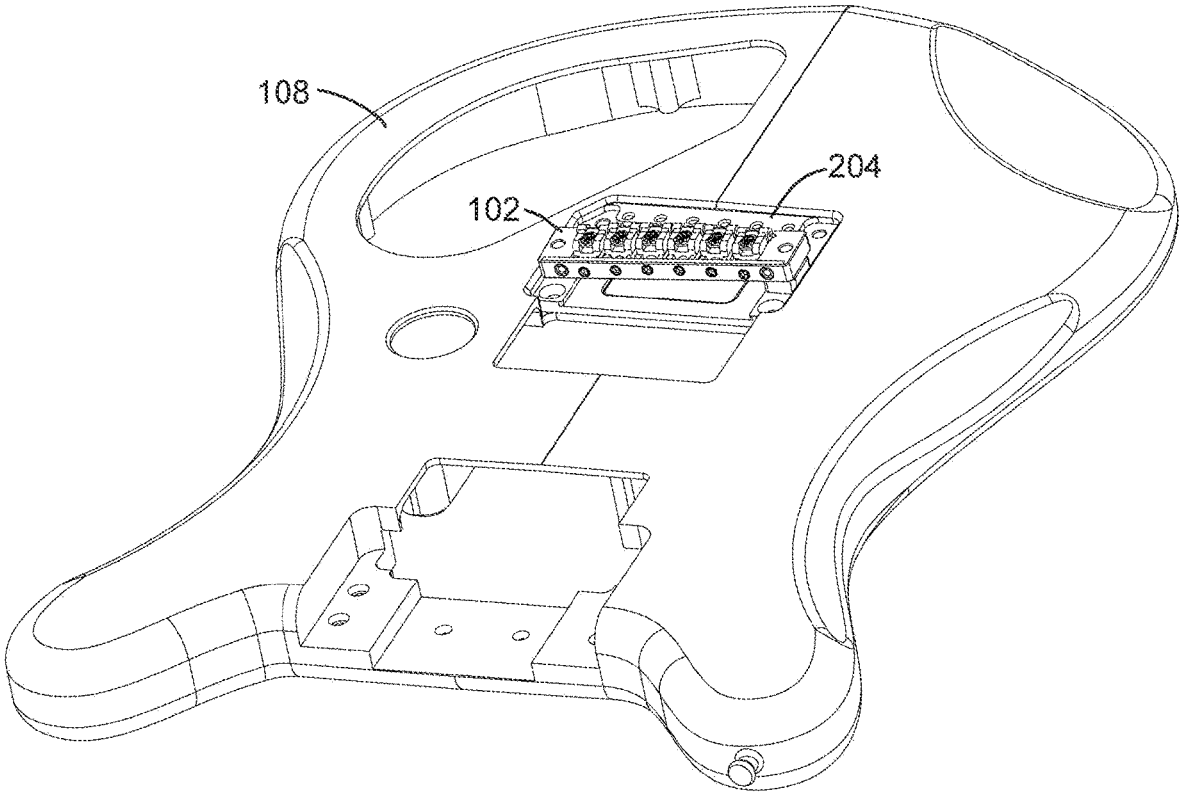
FIG. 29 is a perspective view of the body 108 of a stringed musical instrument that features an alternative bridge plate 204 that may be modified to uniquely provide adjustability of the bridge 102 in six degrees of freedom (e.g. forward/backward, up/down, left/right, plus pitch, yaw, and roll).

FIG. 29 is a perspective view of the body 108 of a stringed musical instrument that, for example, features an alternative bridge plate 204 that may be modified to uniquely provide adjustability of the bridge 102 in six degrees of freedom (e.g. forward/backward, up/down, left/right, plus pitch, yaw, and roll).

FIGS. 30A, 30B, 30C, 31A, 31B, and 31C, for example, show an alternative bridge plate 204 that, instead of providing two different elevations, uniquely provides adjustability in all six degrees of motion (but with left/right motion generally being omitted since the bridge 102 is necessarily aligned with the strings).

Figure 4A:
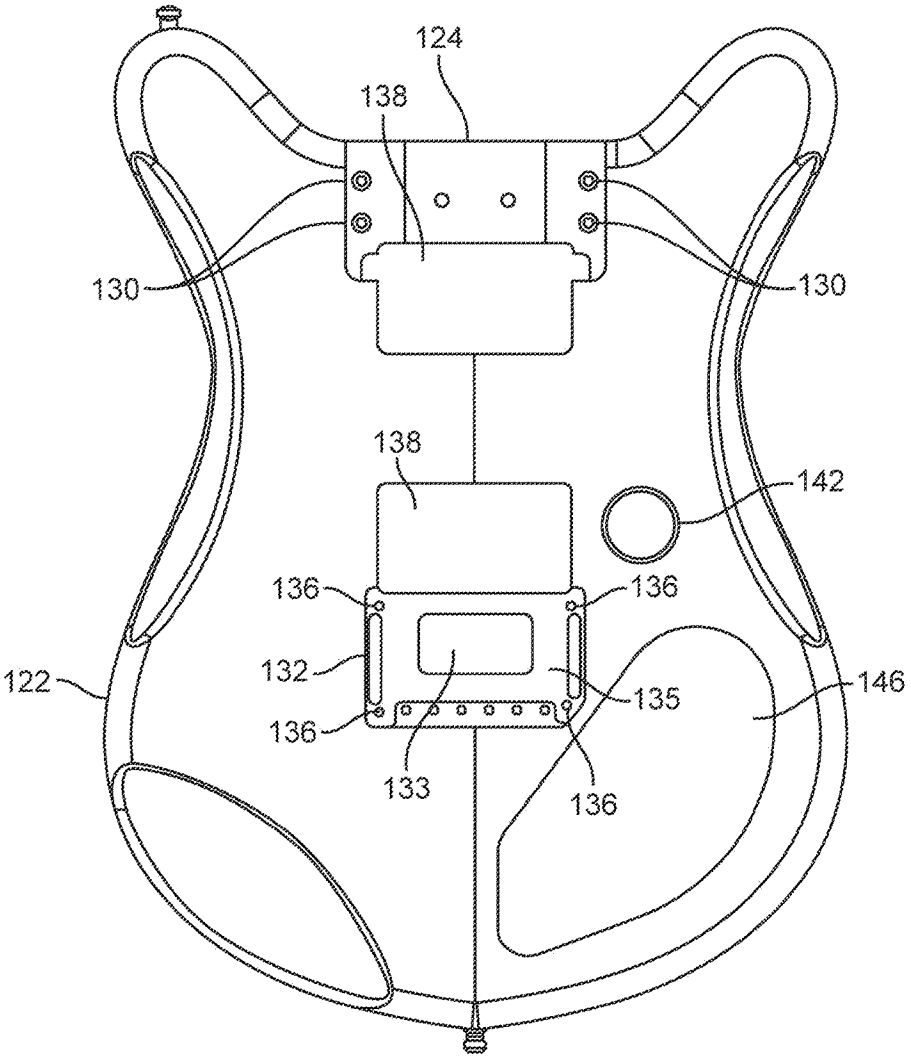
FIG. 4A is a top view of the body of the stringed musical instrument.
Figure 5A:
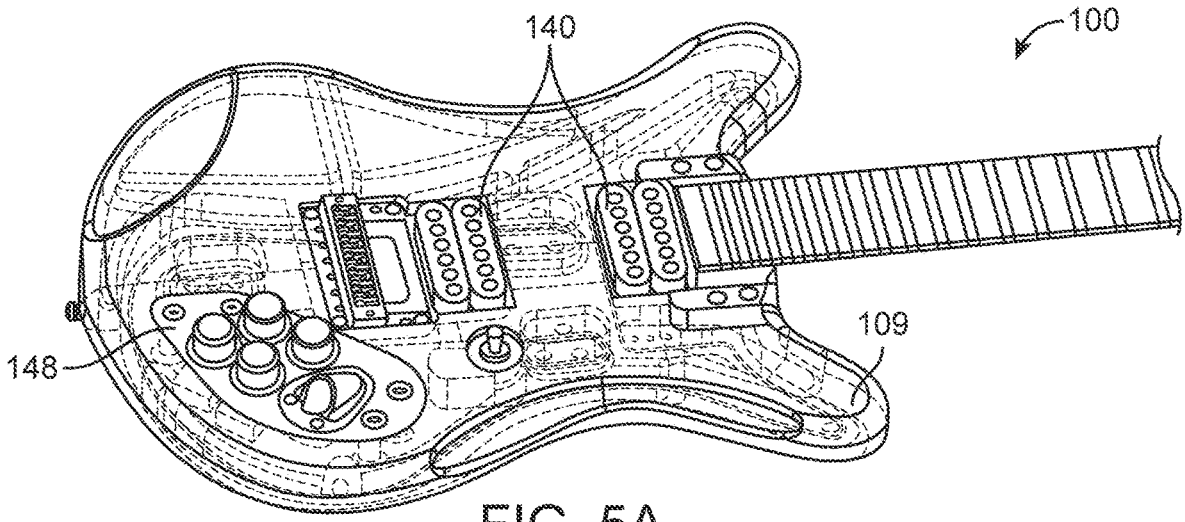
FIG. 5A is sectional view of an assembled body and neck of the stringed musical instrument.
Figure 5B:
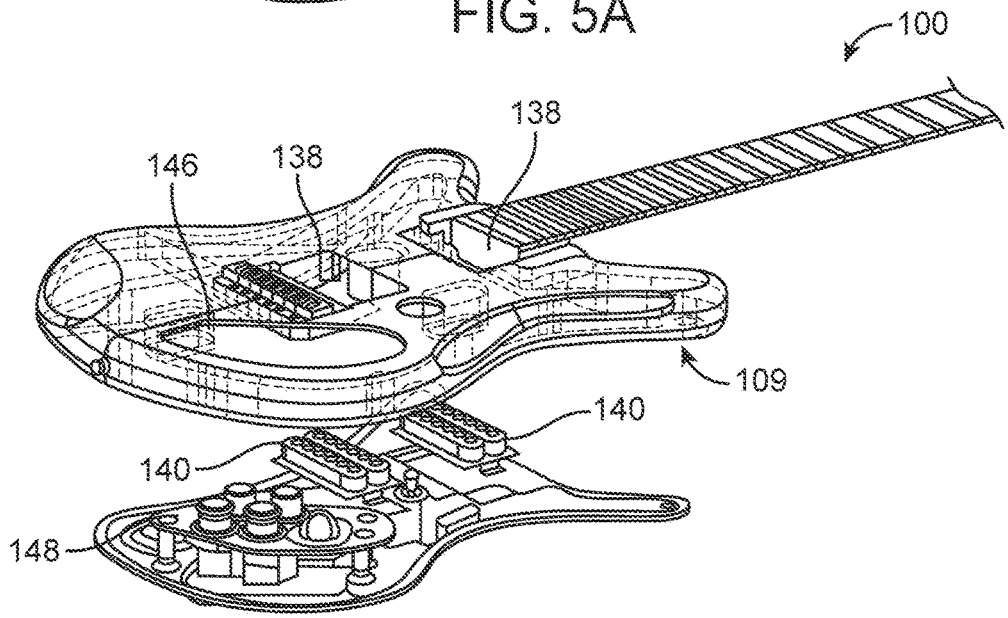
FIG. 5B is sectional view of a disassembled body and neck of the stringed musical instrument.
Figure 30A:
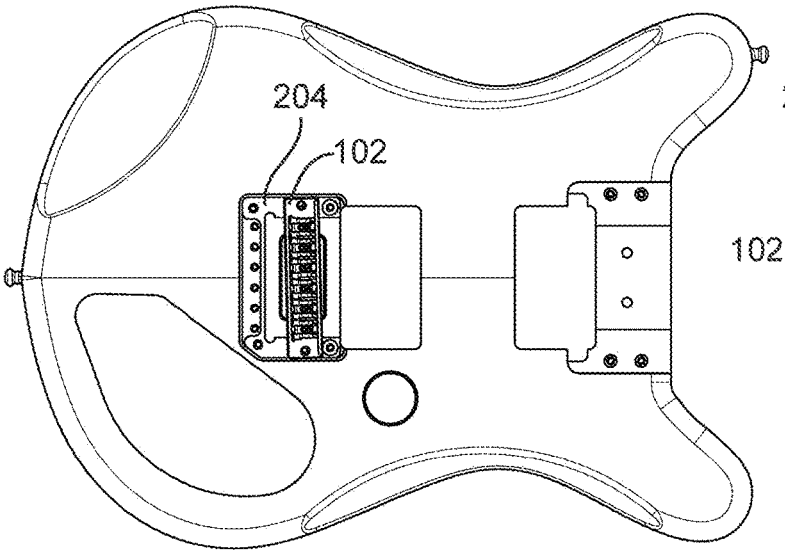
FIG. 30A is a top view of the body 108 of a stringed musical instrument that is comparable to that of FIG. 4A but features an alternative bridge plate 204 that may be modified to uniquely provide adjustability of the bridge 102 in six degrees of freedom (e.g. forward/backward, up/down, left/right, plus pitch, yaw, and roll).
Figure 30B:
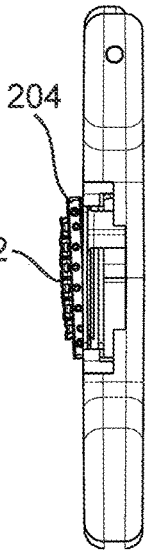
FIG. 30B is a neck-side side view of the stringed musical instrument of FIG. 29A with the alternative bridge plate 204.
Figure 30C:
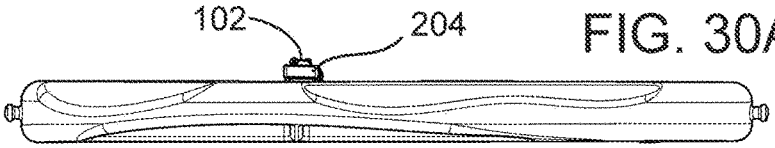
FIG. 30C is a side view of the body of the stringed musical instrument of FIG. 29A with the alternative bridge plate 204.

FIG. 30A is a top view of the body 108 of a stringed musical instrument that is comparable to that of FIG. 4A but features an alternative bridge plate 204 that may be modified to uniquely provide adjustability of the bridge 102 in six degrees of freedom (e.g. forward/backward, up/down, left/right, plus pitch, yaw, and roll). FIG. 30B is a neck-side side view of the stringed musical instrument of FIG. 29A with the alternative bridge plate 204. FIG. 30C is a side view of the body of the stringed musical instrument of FIG. 29A with the alternative bridge plate 204.

Figure 31C:
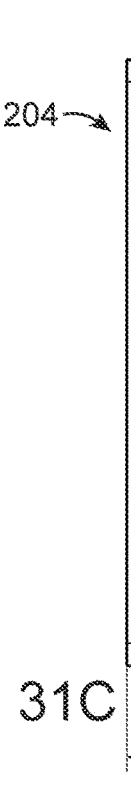
FIG. 31C is an elevational end view of the alternative bridge plate 204 showing the left- and right-side support surfaces 281L, 281R angled at 2.5° along the Y axis and rising to different heights along the Z axis.
Figure 31A:
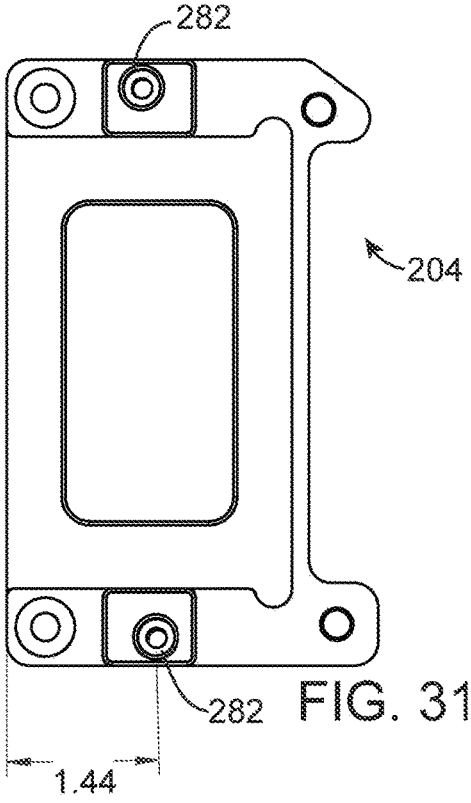
FIG. 31A is a top view of the alternative bridge plate 204 showing the left- and right-side support surfaces 281L, 281R.

FIG. 31A is a top view of the alternative bridge plate 204 showing the left- and right-side support surfaces 281L, 281R. As shown, the post holes 282 that receive the bridge (not shown) can be moved forward or backward in the X-axis as desired. Here, the top-most post hole 282 is more forward the lower-most post hole 282 to also provide some degree of yaw.

Figure 31B:
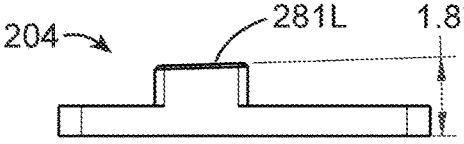
FIG. 31B is an elevational sided view of the alternative bridge plate 204 showing how the left- and right-side support surfaces 281L, 281R angled at 1.8° along the X axis.

FIG. 31B is an elevational sided view of the alternative bridge plate 204 showing how the left- and right-side support surfaces 281L, 281R may be angled to provide a desired pitch, here being machined to be at 1.8° along the X axis.

FIG. 31C is an elevational end view of the alternative bridge plate 204 showing how the left- and right-side support surfaces 281L, 281R may be varied in relative height and angle to provide a desired roll, here rising to different heights along the Z axis angled at 2.5° along the Y axis.

Neck/Fretboard/Neck Head

With respect to FIGS. 18-22, the neck 114 with the detachable fretboard 116 and the detachable neck head 118 are described. The inside of the neck 114 may have a channel 190 (see FIGS. 18 and 19C) that is geometrically varied as desired to provide acoustic benefits via controlled neck distortion. The channel 190 has a profile that forms an elongated rib of desired shape and thickness (not separately numbered) that acts like a truss rod (normally made from a piece of allthread with nut on either end that are tightened to add tension) providing rigidity and stiffness for the neck 114. The channel 190 and associated rib may also act like a tuning fork to transmit vibration which may allow for sustained action.

The neck 114 further includes three holes 194 that align with three holes 192 of the fretboard 116 that allow the neck 114 and the fretboard 116 to be secured together via bolts or screws. More specifically, the fretboard 116 may be attached to the neck 114 with bolts 193. In one embodiment, the placement of the holes 192, 194 visually and, ideally, tactilely denote the octave points on a fretboard. Furthermore, the bolts 193 may slightly protrude (See FIG. 22) from the back side of the neck 114 allowing the user to play by feel, such that by the user sliding his or her hand along the back of the neck 114 the user may feel where the octave points are due to the extension of the bolts 193 from the underside of the neck 114. Thus, the holes 192, 194 and bolts 193 combine to visually and, ideally, tactilely denote the octave points.

The octave points can be located at any three points. So, beneficially, the holes 192, 194 and bolts 193 may be set at the octave points for any fretboard, e.g. a 24" fretboard, a 24.75" fretboard, a 25" fretboard, or a 25.5" fretboard.

In one embodiment, the fretboard 116 is type 2 anodized, which may allow aluminum to be used as the material to construct the fretboard 116. The type 2 anodized fretboard may provide a thin layer of sapphire that is harder than the strings, which may be stainless strings.

The fretboard 116 is uniquely modular which allows for a wide range of scale lengths (within the capacity of the musical instrument 100), fret heights, and styles (e.g., scalloped, fretless, and the like). In one embodiment, the fretboard 116 may be fully machined from one piece of aluminum. The fretboard 116 may then be coated with type 2 anodizing, which may provide superior durability than rosewood and glued-in stainless steel frets. This configuration may allow a new fretboard to be purchased and then replaced in the neck 114 for less than the cost of what the fretboard would be for a luthier to replace the frets in a guitar.

Figure 23A:
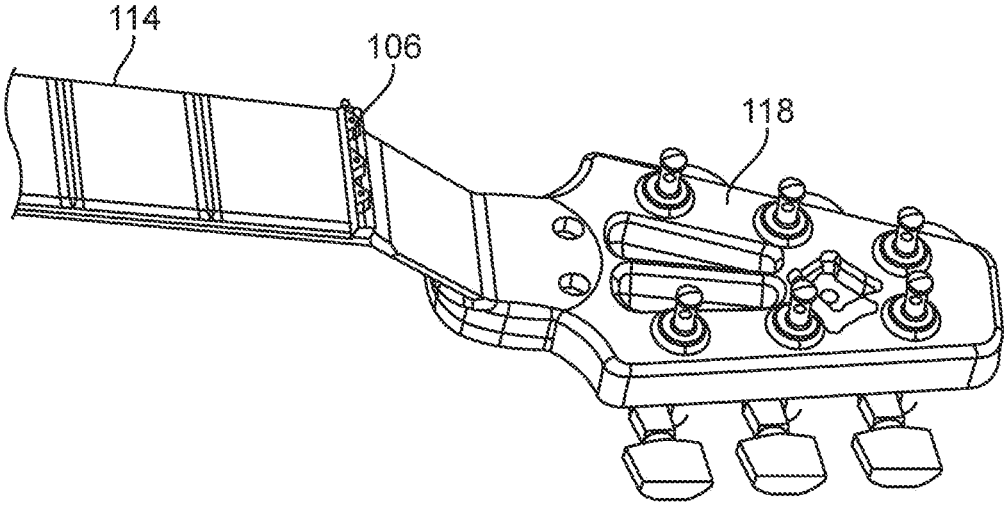
FIG. 23A is a perspective view of the neck connected to the neck head.
Figure 23B:
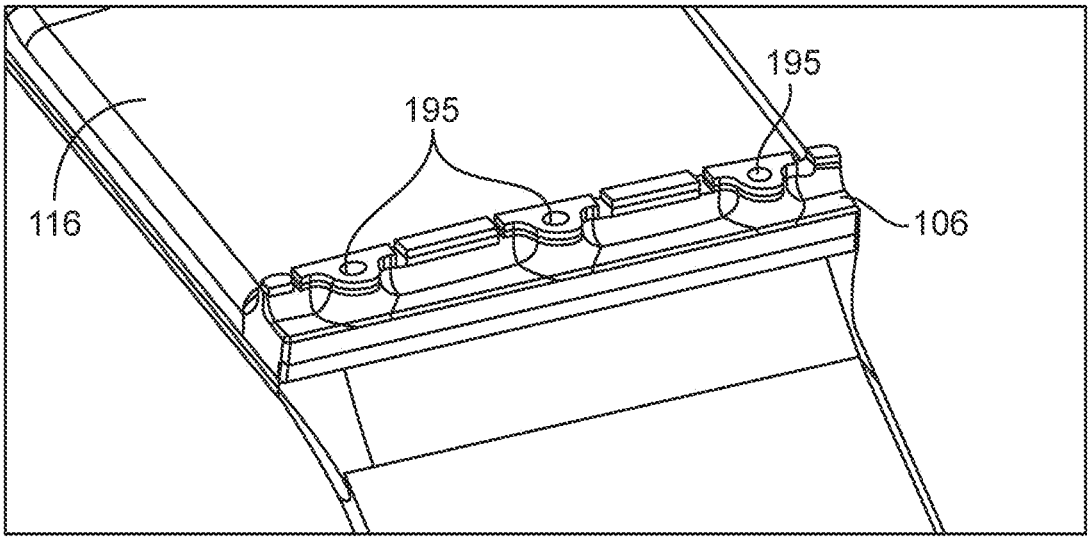
FIG. 23B is a perspective view of the neck connected to the neck head showing details of the assembly.
Figure 24A:
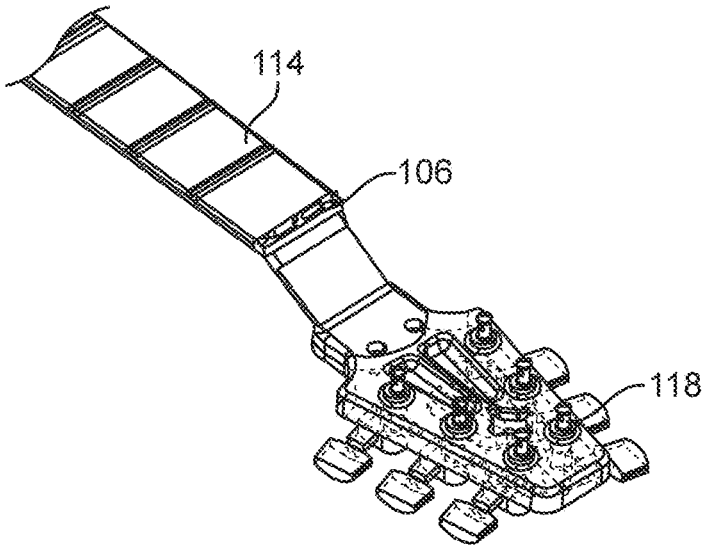
FIG. 24A is a perspective, sectional view of attachment of the neck head to the neck.
Figure 24B:
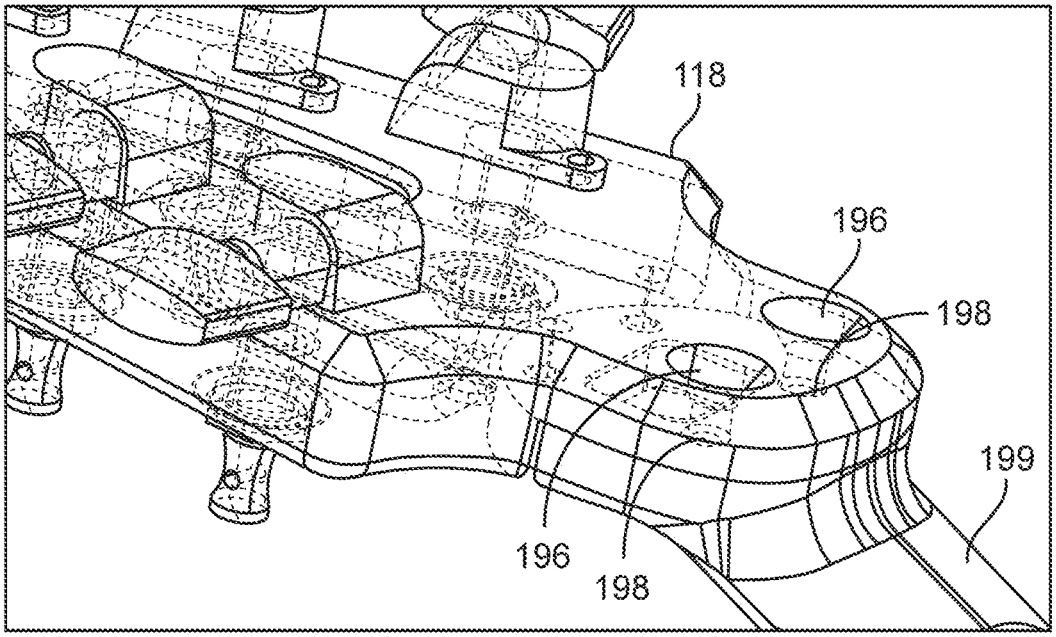
FIG. 24B is a perspective, sectional view of attachment of the neck head to the neck showing greater details.
Figure 25:
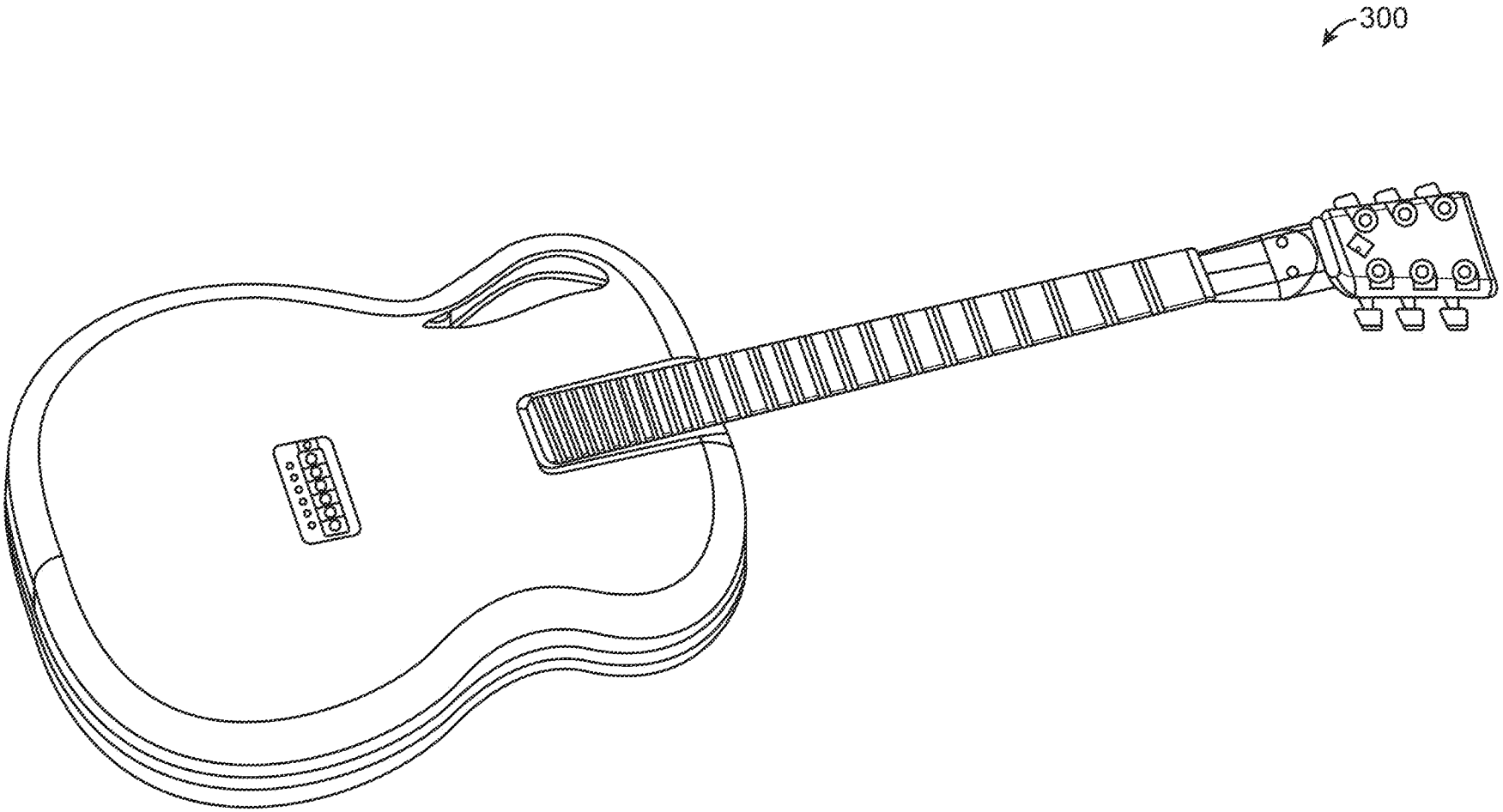
FIG. 25 is a top perspective view of another alternative musical instrument with interchangeable parts.
Figure 26:
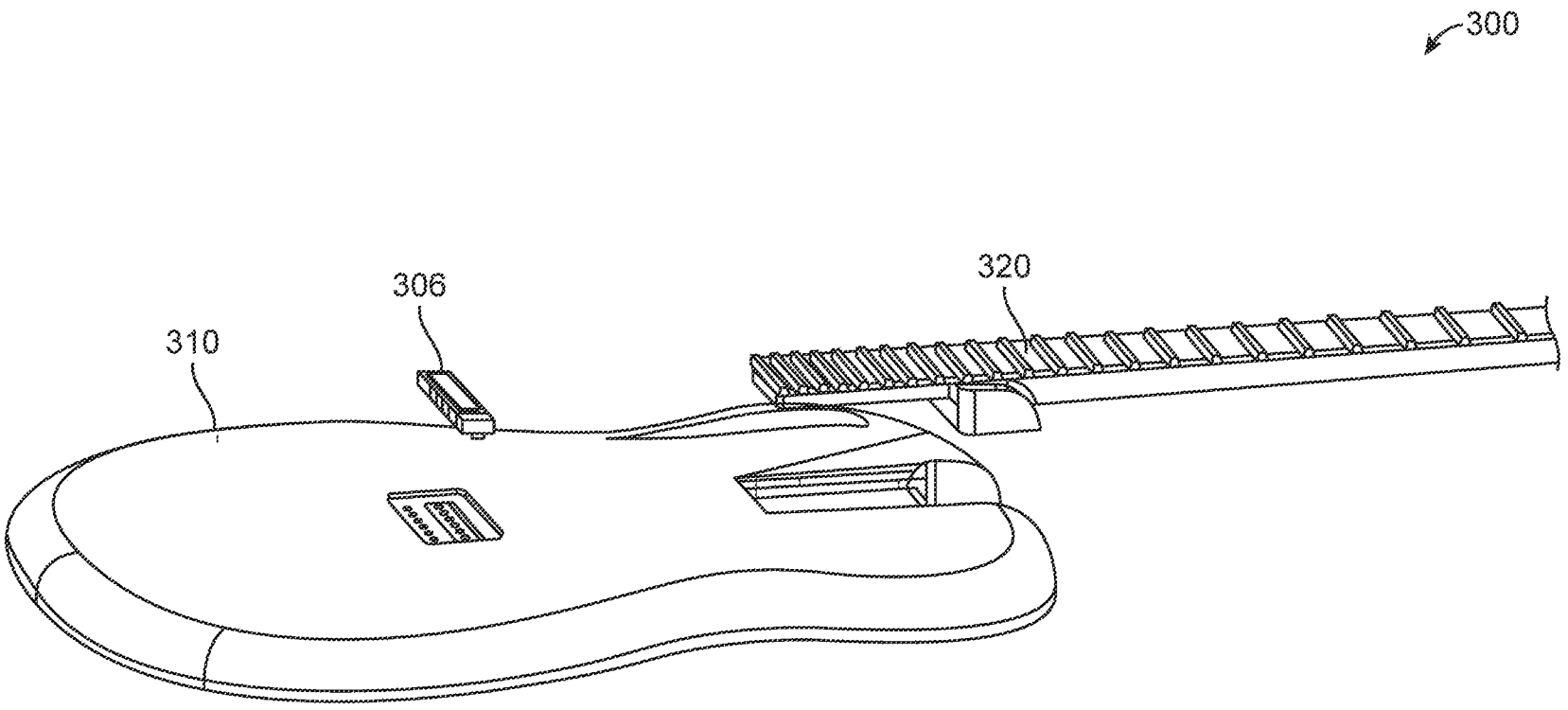
FIG. 26 is an exploded view of the musical instrument.
Figure 27:
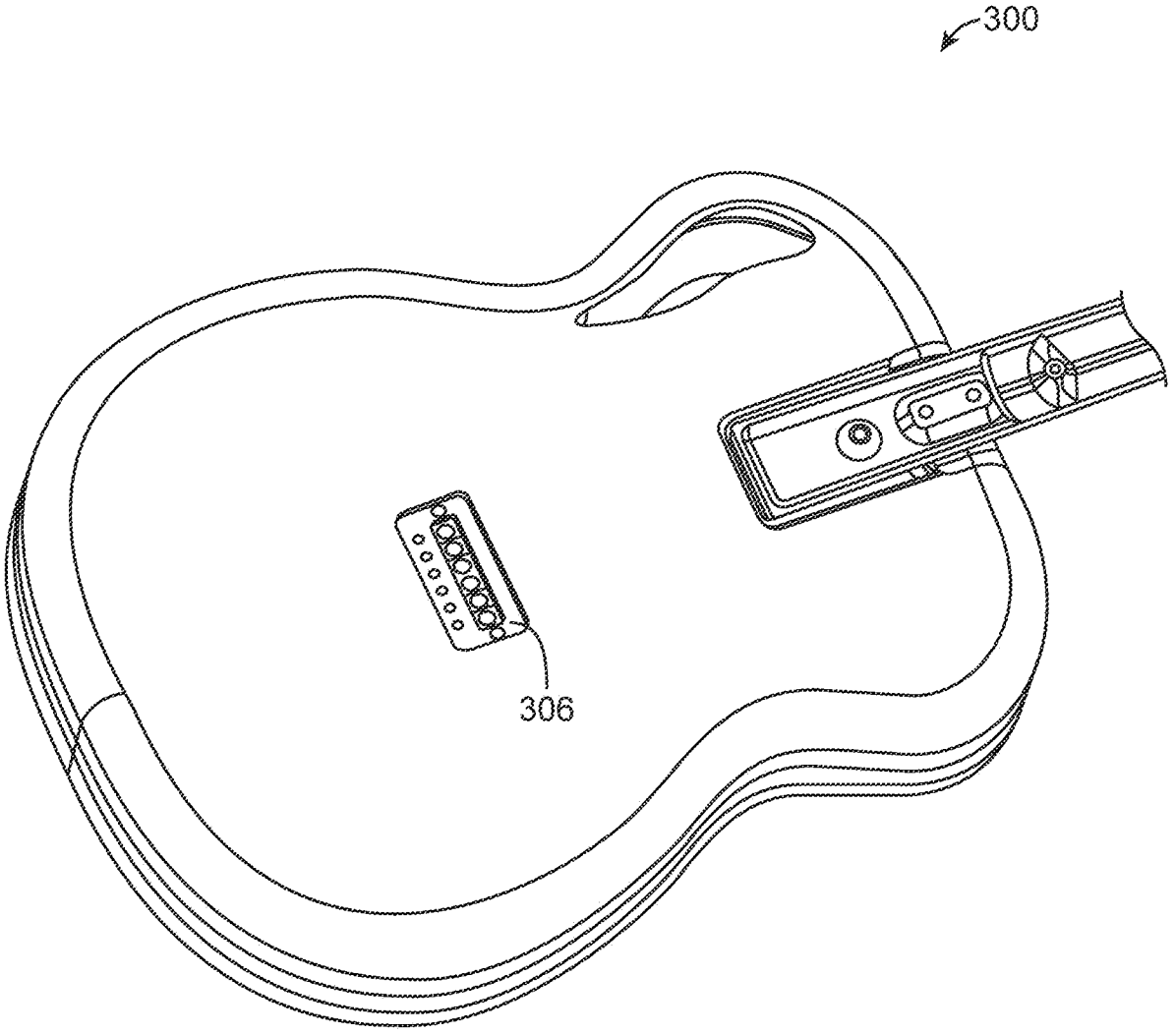
FIG. 27 is a bridge associated with the musical instrument.
Figure 28:
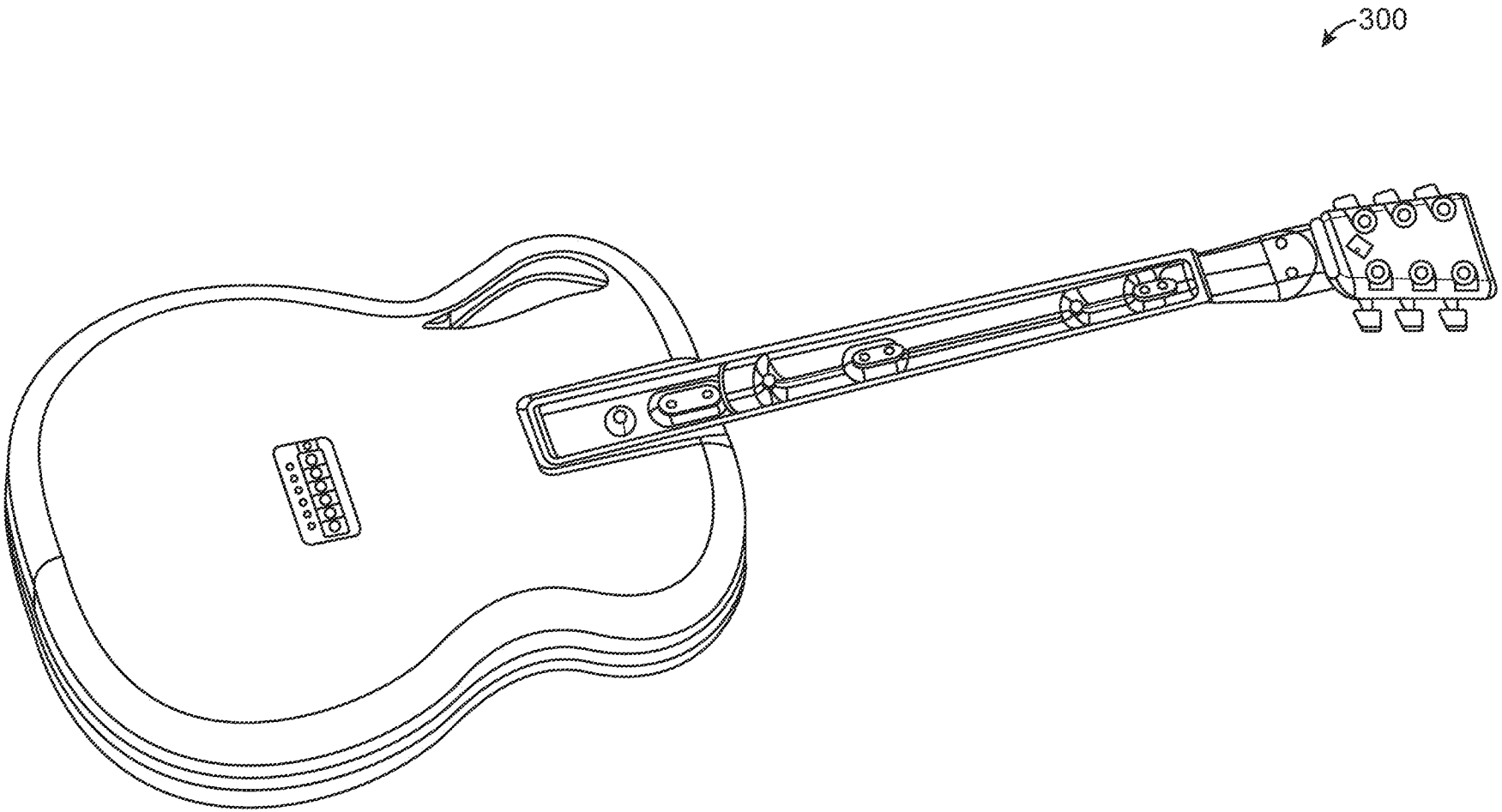
FIG. 28 is a top perspective view of the musical instrument with a fretboard detached.

With respect to FIGS. 23 and 24, the neck 114 and detachable neck head 118 are illustrated. The ability to remove and attach a headstock is achieved by locating the headstock using a pocket and register technology this is important to repeating the setup and rigidity being able to change headstock styles allows musicians to select an instrument that is personal and represents their preferences it also allows for the easy implementation of different handedness. This is not only true of just the headstock but also the neck body bridge fretboard nut and virtually every component on the savant instrument. The nut 106 (see also FIG. 1) may include mechanical fasteners 195 to attach the nut 106 to the fretboard 116 as opposed to an epoxy. Therefore, the nut 106 may be interchangeable along with the fretboard 116. In one embodiment, the nut 106 is precision-machined to match the fret height of the of the frets on the fretboard 116 in order to give the musical instrument 100 the correct string action in accordance with the user's preferences. Furthermore, the user may not require a luthier to go over the set up to have the string heights adjusted at the nut 106.

In one embodiment, the neck head 118 may have two pockets 196 at the base of the neck head that align with two holes 198 of a neck bridge 199 of the neck 114. A screw may be threaded through each pocket 196 and into the corresponding hole 198 to secure the neck head 118 to the neck bridge 199. Configured as such, a user is able to change neck head styles to select an instrument that matches the user's preferences. The easy modularity/detachability may further provide for different scale lengths and implementation of different handedness (e.g., left or right handedness).

With respect to FIGS. 25-28, it is shown that the modularity and detachability of parts of the musical instrument 100 (e.g., electric guitar) may be applied with similar value to yet another musical instrument, such as an acoustic guitar 300. In one embodiment, the bridge 306 is similar to the bridge 102 of musical instrument 100 (an electric guitar), but it fits in just one position because virtually all acoustic players like a 25" scale length. The acoustic guitar 300 could also include the unique fretboard. However, it should be understood that the adjustable neck bridge assembly described above is specific to electric guitars. Furthermore, the acoustic guitar 300 may have a neck 320 that is attachable and detachable to a body 310 in the same manner as the musical instrument 100.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A modular stringed instrument comprising:

a body comprising a top portion and a bottom portion, the bottom portion having a generally flat rear surface and a bottom portion perimeter, the bottom portion having an inner surface opposite the generally flat rear surface;

the top portion having a face and vertical walls extending downward forming an outermost perimeter of the body, the top portion configured to receive and detachably couple with the bottom portion, the vertical walls of the top portion engaging with the bottom portion perimeter, the top portion and the bottom portion forming an inner cavity, the top portion having a neck receiving portion and a bridge assembly receiving portion, the bridge assembly receiving portion comprising one or more nonplanar features;

a bridge assembly comprising:

a bridge and a bridge plate, an upper portion of the bridge plate detachably coupled to the bridge, the bridge plate detachably coupled to the bridge assembly receiving portion of the top portion of the body, the bridge plate having a bridge plate assembly portion that is inversely contoured to the nonplanar features of the bridge assembly portion to receive and interlock with the bridge assembly receiving portion, wherein the bridge plate assembly portion is shaped to precisely position and secure the bridge plate on the top portion of the body;

a neck detachably coupled to the top portion of the body; and, a neck head detachably coupled to the neck.

2. The modular stringed instrument of claim 1 wherein the upper portion of the bridge plate is adapted to allow for positional adjustment of the bridge.

3. The modular stringed instrument of claim 2, wherein the bridge plate provides positional adjustment of the bridge in one or more of forward/backward, up/down, left/right, pitch, yaw, and roll.

4. The modular stringed instrument of claim 3, wherein the bridge plate comprises a first surface having a first thickness $t_1$ and a raised step having a second thickness $t_2$, where $t_2$ is greater than $t_1$, wherein for coarse adjustment of string action the bridge is coupled to the bridge plate 104 on the first surface or coupled to the raised step.

5. The modular stringed instrument of claim 3, wherein the bridge plate comprises left- and right-side support posts of differing height that position the bridge at a desired roll.

6. The modular stringed instrument of claim 3, wherein the bridge plate comprises left- and right-side support posts with upper support surfaces that are angled to position the bridge at a desired pitch.

7. The modular stringed instrument of claim 3, wherein the bridge plate comprises left- and right-side support posts with post holes that are varied to position the bridge at a desired yaw.

8. The modular stringed instrument of claim 1, wherein:

the one or more nonplanar features of the bridge assembly receiving portion comprises a flat surface and a raised surface, and the bridge plate is contoured to have an inner aperture to receive the raised surface of the bridge receiving portion.

9. The modular stringed instrument of claim 1, wherein the bridge plate accommodates a scale length of between 24 inches and 26 inches.

10. The modular stringed instrument of claim 9, wherein the bridge plate accommodates a scale length of 25.5 inches or a scale length of 24.75 inches.

11. The modular stringed instrument of claim 9, wherein the bridge plate accommodates a scale length of 24 inches or a scale length of 25 inches.

12. The modular stringed instrument of claim 1, wherein the bridge further comprises adjustable claw pads for each string to allow for micro-adjustments of each string forward and backward in a direction parallel with the strings and raised and lowered in a vertical direction perpendicular to the strings.

13. The modular stringed instrument of claim 1, wherein the modular string instrument is assembled using mechanical fasteners without the use of adhesives.

14. The modular stringed instrument of claim 1, wherein the bridge assembly is custom machined for a user.

15. The modular stringed instrument of claim 1, wherein one or more of the following are be customized to a user's preference: head stock style, the left-right handedness, the neck thickness, the scale length, the body style, and/or electronics.

16. The modular stringed instrument of claim 1, wherein the neck comprises a channel formed in the inner surface of the neck, the channel providing rigidity and stiffness for the neck.

17. The modular stringed instrument of claim 1, further comprising a fretboard detachably coupled to the neck, wherein the neck and the fretboard each having three holes that allow the neck and the fretboard to be secured together via mechanical fasteners, wherein the placement of the holes visually and tactilely denote the octave points on the fretboard.

18. The modular stringed instrument of claim 17 wherein the three holes in the neck and fretboard have a placement that denotes the octave points for one of a 24 fretboard, 24.75" fretboard, 25" fretboard, and 25.5" fretboard.

19. A modular stringed instrument comprising:

a body comprising a top portion and a bottom portion, the bottom portion having a generally flat rear surface and a bottom portion perimeter, the bottom portion having and an inner surface opposite the generally flat rear surface, the inner surface supporting instrument electronics extending upward away from the inner surface;

the top portion having a face and vertical walls extending downward forming an outermost perimeter of the body, the top portion configured to receive and detachably couple with the bottom portion, the vertical walls of the top portion engaging with the bottom portion perimeter, the top portion and the bottom portion forming an inner cavity, the top portion having a neck receiving portion and a bridge assembly receiving portion, the bridge assembly receiving portion comprising one or more nonplanar features, the top portion having apertures for receiving the instrument electronics of the bottom portion;

a bridge assembly comprising:

a bridge and a bridge plate, the bridge plate detachably coupled to the bridge, the bridge plate detachably coupled to the bridge assembly receiving portion of the top portion of the body, the bridge plate inversely contoured to the nonplanar features of the bridge assembly portion to receive and interlock with the bridge assembly receiving portion, wherein the bridge plate assembly portion is shaped to precisely position and secure the bridge plate on the top portion of the body;

a neck having a neck base portion at one end of the neck and a neck top portion on the end of the neck opposite the neck base portion, the neck base portion detachably coupled to the neck receiving portion of the top portion of the body;

a neck head detachably coupled to the neck.

20. The modular stringed instrument of claim 19, wherein for coarse adjustment of string action the bridge plate comprises a first surface having a first thickness $t_1$ and a raised step having a second thickness $t_2$, where $t_2$ is greater than $t_1$, wherein the bridge is coupled to the bridge plate on the first surface or coupled to the raised step.

21. The modular stringed instrument of claim 19, wherein:

the one or more nonplanar features of the bridge assembly receiving portion comprises a flat surface and a raised surface, and the bridge plate is contoured to have an inner aperture to receive the raised surface of the bridge receiving portion.

22. The modular stringed instrument of claim 19, wherein the bridge further comprises adjustable claw pads for each string to allow for micro-adjustments of each string forward and backward in a direction parallel with the strings and raised and lowered in a vertical direction perpendicular to the strings.

23. The modular stringed instrument of claim 19, wherein the neck comprises a channel formed in the inner surface of the neck, the channel providing rigidity and stiffness for the neck.

24. The modular stringed instrument of claim 19, further comprising a fretboard detachably coupled to the neck, wherein the neck and the fretboard each having three holes that allow the neck and the fretboard to be secured together via mechanical fasteners, wherein the placement of the holes visually and tactilely denote the octave points on the fretboard.

25. The modular stringed instrument of claim 24 wherein the three holes in the neck and fretboard have a placement that denotes the octave points for one of a 24 fretboard, 24.75" fretboard, 25" fretboard, and 25.5" fretboard.

26. A modular stringed instrument comprising:

a body comprising a top portion and a bottom portion, the bottom portion having a generally flat rear surface and a bottom portion perimeter, the bottom portion having and an inner surface opposite the generally flat rear surface, the inner surface supporting instrument electronics extending upward away from the generally flat rear surface;

the top portion having a face and vertical walls extending downward from an outermost perimeter of the face, the top portion configured to receive and detachably couple with the bottom portion, the vertical walls of the top portion engaging with the bottom portion perimeter, the top portion and the bottom portion forming an inner cavity, the top portion having apertures for receiving the instrument electronics of the bottom portion, the top portion having a neck receiving portion and a bridge assembly receiving portion, the bridge assembly receiving portion comprising a flat surface and a raised surface forming a rectangle;

a bridge assembly comprising:

a bridge and a bridge plate, the bridge plate detachably coupled to the bridge and to the bridge receiving portion of the top portion of the body, the bridge plate having an inner rectangle aperture to receive the raised surface of the bridge receiving portion, wherein the inner aperture forms a rectangle surrounding the raised surface of the neck receiving portion of the top portion precisely positions and secures the bridge plate;

a neck having a neck base portion at one end of the neck and a neck top portion on the end of the neck opposite the neck base portion, the neck base portion detachably coupled to the neck receiving portion of the top portion of the body; and, a neck head detachably coupled to the neck 114.

27. The modular stringed instrument of claim 26, wherein for coarse adjustment of string action the bridge plate comprises a first surface having a first thickness $t_1$ and a raised step having a second thickness $t_2$, where $t_2$ is greater than $t_1$, wherein the bridge is coupled to the bridge plate on the first surface or coupled to the raised step.

28. The modular stringed instrument of claim 26, wherein the neck comprises a channel formed in the inner surface of the neck and having a profile that creates an elongated rib, the channel and elongated rib formed therein providing rigidity and stiffness for the neck that relate to acoustic benefits.

29. The modular stringed instrument of claim 26, further comprising a fretboard detachably coupled to the neck, wherein the neck and the fretboard each having three holes that allow the neck and the fretboard to be secured together via mechanical fasteners, wherein the placement of the holes visually and tactilely denote the octave points on the fretboard.

30. The modular stringed instrument of claim 29 wherein the three holes in the neck and fretboard have a placement that denotes the octave points for one of a 24 fretboard, 24.75" fretboard, 25" fretboard, and 25.5" fretboard.

* * * * *